US010016974B2

(12) United States Patent
van Brocklin et al.

(10) Patent No.: US 10,016,974 B2
(45) Date of Patent: Jul. 10, 2018

(54) ACTUATING ELEMENT DRIVER CIRCUIT WITH TRIM CONTROL

(71) Applicant: Xaar Technology Limited, Cambridge (GB)

(72) Inventors: Andrew L. van Brocklin, Corvallis, OR (US); Stephen Mark Jeapes, Cambridge (GB); Ian Anthony Hurst, Wilburton (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 14/850,204

(22) Filed: Sep. 10, 2015

(65) Prior Publication Data

US 2016/0067963 A1 Mar. 10, 2016

(30) Foreign Application Priority Data

Sep. 10, 2014 (GB) ..... 1415986.7

(51) Int. Cl.
*B41J 2/045* (2006.01)

(52) U.S. Cl.
CPC ..... *B41J 2/04573* (2013.01); *B41J 2/0459* (2013.01); *B41J 2/04541* (2013.01); *B41J 2/04581* (2013.01); *B41J 2/04588* (2013.01)

(58) Field of Classification Search
CPC ..... B41J 2/04573; B41J 2/04588; B41J 2/04541; B41J 2/0459; B41J 2/04581; B41J 2/0455; B41J 2/30; B41J 2/04546
See application file for complete search history.

(56) References Cited

U.S. PATENT DOCUMENTS 5,453,767 A 9/1995 Chang et al.
6,276,772 B1 8/2001 Sakata et al.
(Continued)

FOREIGN PATENT DOCUMENTS

JP 61209166 A * 9/1986 ..... B41J 2/04541
JP S61209166 A 9/1986
(Continued)

OTHER PUBLICATIONS

Search Report dated Mar. 11, 2015 for GB Application No. 1415986.7, 5 pages.
(Continued)

*Primary Examiner* — Patrick King
(74) *Attorney, Agent, or Firm* — Patterson Thuente Pedersen, P.A.

(57) ABSTRACT

A driver circuit for driving actuating elements for printing, has a switch for coupling a common drive signal to provide element drive pulses to drive each actuating element according to a print signal. A timing control circuit controls the switch during sloped transitions of the common drive signal, to trim an amplitude of the actuating element drive pulses according to a common offset configurable for at least two of the actuating elements in common, and according to an element specific offset, configurable for each of the actuating elements. The offsets can be dynamic or static, and some parts of the timing can be implemented in analog form. This enables more types of errors to be compensated, and can enable the element specific offset to be implemented with simpler circuitry with less heat dissipation or less space or needing less precision and thus less cost.

14 Claims, 17 Drawing Sheets

(56) References Cited

U.S. PATENT DOCUMENTS 9,399,342 B2 * 7/2016 Marchant ..... B41J 2/0459
2001/0026292 A1 * 10/2001 Ishizaki ..... B41J 2/04541 347/12
2002/0145639 A1 * 10/2002 Masuda ..... B41J 2/04541 347/14
2003/0234826 A1 12/2003 Hosono et al.
2005/0041073 A1 2/2005 Fontaine et al.
2005/0200639 A1 9/2005 Kobayashi et al.
2005/0231179 A1 10/2005 Ishizaki
2006/0092201 A1 * 5/2006 Gardner ..... B41J 2/04508 347/10
2007/0296771 A1 12/2007 Ou et al.
2008/0186339 A1 * 8/2008 Kondoh ..... B41J 2/04581 347/9
2008/0238969 A1 * 10/2008 Kasai ..... B41J 2/04541 347/12
2009/0033306 A1 2/2009 Tanzawa
2009/0207200 A1 * 8/2009 Tamura ..... B41J 2/04505 347/9
2009/0212831 A1 8/2009 Kondoh
2010/0097114 A1 * 4/2010 Miyazaki ..... H03K 7/08 327/176
2010/0171778 A1 7/2010 Ozawa
2010/0328380 A1 * 12/2010 Oshima ..... B41J 2/04541 347/10
2011/0063009 A1 * 3/2011 Tseng ..... G05F 1/575 327/306
2011/0273498 A1 * 11/2011 Kasai ..... B41J 2/04541 347/10
2012/0249638 A1 10/2012 Takano et al.
2012/0262512 A1 10/2012 Oshima et al.
2013/0057610 A1 * 3/2013 Van Brocklin ..... B41J 2/04581 347/10
2013/0321507 A1 12/2013 Mardilovich et al.
2014/0098149 A1 4/2014 Endo et al.
2014/0152726 A1 * 6/2014 Van Brocklin ..... B41J 2/0458 347/10
2014/0210884 A1 * 7/2014 Rosario ..... B41J 2/04588 347/10
2015/0197083 A1 * 7/2015 Otsuka ..... B41J 2/04541 347/10
2015/0336383 A1 * 11/2015 Otsuka ..... B41J 2/04541 347/68
2016/0067960 A1 * 3/2016 Marchant ..... B41J 2/04586 347/10
2017/0259562 A1 9/2017 van Brocklin

FOREIGN PATENT DOCUMENTS

JP H 068428 A 1/1994
JP 2006240167 A * 9/2006
WO WO 2010/055345 A1 5/2010

OTHER PUBLICATIONS

Application and File history for U.S. Appl. No. 14/850,303, filed Sep. 10, 2015. Inventor: Marchant.
Application and File history for U.S. Appl. No. 14/850,153, filed Sep. 10, 2015. Inventors: Blomquist et al.
Search Report dated Mar. 9, 2015 for GB Application No. 1415987.5, 5 pages.
Search Report dated Mar. 11, 2015 for GB Application No. 1415988.3, 6 pages.
Office Action dated Aug. 24, 2017 for Japanese Application No. 2015177745, 9 pages.
Search Report and Written Opinion dated Nov. 25, 2015 for PCT Application No. PCT/GB2015/052610, 11 pages.
Search Report dated Mar. 9, 2015 for GB Application No. 1415991.7, 5 pages.

* cited by examiner 35
30
25
20
15
10
5
0
-5
0
0.000002
0.000004
0.000006
0.000008
0.00001
0.000012
MutlipleRamp
Actuator1
Actuator2
Ramp1CTRL
Ramp2CTRL

ACTUATING ELEMENT DRIVER CIRCUIT WITH TRIM CONTROL

RELATED APPLICATION

The present application claims priority to GB Application No. 1415986.7 filed Sep. 10, 2014, which is hereby incorporated herein in its entirety by reference.

TECHNICAL FIELD

The present invention relates to driver circuitry, for driving actuating elements for printheads, and to printers having such driver circuitry.

BACKGROUND

It is known to provide printhead circuits for printers such as inkjet printers. For example, the inkjet industry has been working on how to drive piezoelectric printhead actuating elements for more than twenty years. Multiple drive methods have been produced and there are multiple different types in use today Some are briefly discussed now.

Hot Switch: This is the class of driving methods that keep the demux function and the power dissipation (CV^2) in the same driver IC. This was the original drive method, before cold switch became popular.

Rectangular Hot Switch: This describes hot switch systems that have no flexible control over rise and fall time and only two voltages (0V and 30V for example). In some cases waveform delivery is uniform to all the actuating chambers. The waveform has some level of programmability.

DAC (Digital to Analog Converter) Hot Switch describes a class of drive options that has a logic driving an arbitrary digital value stream to a DAC per actuating chamber, outputs a high voltage drive power waveform scaled from this digital stream. In terms of driving flexibility, this option has the most capability. It is limited only by the number of digital gates and the complexity that system designers can use and/or tolerate.

Cold Switch Demux: This describes an arrangement in which all actuating elements are fed the same drive signal through a pass gate type demultiplexer. The drive signal can be gated at sub-pixel speeds.

It is also known to provide some factory calibration of differences between individual actuating chambers and to provide compensation by trimming the drive signal applied to the different actuating elements. Such trimming can be by time division of a common drive circuit or by separate control of individual drive circuits for each of the actuating elements.

US 2005200639 shows a printer with driver circuitry for actuating elements using a common drive waveform applied to one side of the actuating elements and with switches for coupling the other side of the actuating elements to a common return path. The switches are controlled to switch on sloping edges of pulses of the common drive waveform to adjust a height of the pulses, for an array of actuating elements. Adjustments can be made for each printed line so that blocks (a 2×2 array of nozzles) can be varied around an average weighting.

SUMMARY

Embodiments of the invention can provide improved apparatus or methods or computer programs. According to a first aspect of the invention, there is provided a driver circuit for driving actuating elements for printing, the driver circuit comprising: a switch for a respective one of the actuating elements, configured to selectively couple a common drive signal to provide element drive pulses to drive the respective actuating element according to a print signal, a timing control circuit having a common offset circuit to provide a common timing offset relative to a timing reference, configurable for at least two of the actuating elements in common. The timing control circuit also has an element specific offset circuit to provide an element specific timing offset relative to the timing reference, configurable for a respective one of the actuating elements, wherein the timing control circuit is configured to control the switch during sloped edges of the common drive signal, to trim an amplitude of the actuating element drive pulses according to the common timing offset and according to its respective element specific timing offset.

Notably, providing both common and element specific types of offset enables more types of errors to be compensated, and can enable the element specific offset to be implemented with less precision for example so as to reduce an amount of element specific circuitry and thus reduce size and cost. This can enable use of simpler and cheaper circuitry with less dissipation, which can be critical in a printhead driver circuit, particularly where there are many elements. Furthermore, the trim being controlled based on such offsets can enable the circuitry to be more self-contained by reducing or avoiding the need for feedback of the drive voltages. This can enable the circuitry to be kept simpler since such feedback could otherwise involve for example circuitry to divide down the high voltage and interface with the timing control circuit. Also the noise immunity to external noise sources could be reduced by such feedback. See FIG. 1 for example.

Any additional features can be added to any of the aspects, or disclaimed, and some such additional features are described and some set out in dependent claims. One such additional feature is the element specific offset circuits comprising a static component circuit for providing a static component of the timing offset, and the driver circuit having a dynamic component circuit for providing a dynamic timing offset to the timing control circuit. This means that more different types of errors can be compensated, and that by separating the static and dynamic, the updates for the dynamic part don't need to include any static component and so there is more dynamic range available for the dynamic, or the circuitry can be less precise and thus simpler and cheaper for a given range. See FIG. 2 for example.

Another such additional feature is the common offset circuit having candidate timing circuitry arranged to provide a plurality of different candidate timing offsets to each of the element specific offset circuits, and the element specific offset circuits each comprising a selector for selecting which of the candidate timing offsets to use for each respective actuating elements. By generating candidate timing offsets, so that only selection is needed in the element specific offset circuits, the quantity of circuitry which needs to be duplicated for each actuating element can be reduced, though at the cost of needing more interconnect. This can help reduce the overall amount of circuitry, particularly where there are many actuating elements, and thus reduce space, thus keeping costs and heat dissipation low. See FIGS. 15 and 16 for example.

Another such additional feature is the common offset circuit providing a more significant part of the trim and the element specific offset circuit providing less significant part of the trim. This can also help to reduce the amount of circuitry which needs to be duplicated for each of the actuating elements. Again this can help reduce the overall amount of circuitry, particularly where there are many actuating elements, and thus reduce space, thus keeping costs and heat dissipation low.

Another such additional feature is the switch comprising a transistor having a body diode or other additional diode used for the same purpose such as a low voltage drop, power efficient, Schottky diode and being coupled in an open drain configuration such that after the switch has been switched off during a leading edge of the common drive waveform, the body or other diode can conduct during a trailing edge of the common drive waveform to enable the element drive pulse to follow the trailing edge of the common drive waveform. This can enable the element drive pulse to follow the trailing edge without waiting for the switch to be switched on again. This can either avoid the switch being switched on again, or it can avoid the need for precise timing of that switch on. In both cases any circuitry for controlling the timing of the switch on can be made simpler or less precise, and thus reduce space and keep costs and heat dissipation low. See FIG. 14 for example.

Another such additional feature is the timing control circuit having a digital counter configured to provide a delay signal with a configurable time delay relative to a reference time signal, and configured to control the timing of the switch control signal according to the delay signal. A significance of separate common and specific timing offsets and digital counter for timing is that fewer counter bits need to be provided for every actuating chamber, so the circuit can be simpler and cheaper. See FIG. 3 for example.

Another such additional feature is the timing control circuit having an analog delay circuit configured to provide a delay signal with a configurable time delay relative to a reference time signal, and configured to control the timing of the switch control signal according to the delay signal. Such separate common and specific timing offsets being implemented with an analog delay circuit means that simpler circuitry can be provided for every actuating chamber, so the circuit can be simpler and cheaper, and more precision can be realised without a corresponding increase in circuit size. See FIG. 4 for example.

Another such additional feature is the analog delay circuit comprising a ramp circuit configured to provide a ramp signal triggered by the reference time signal and an analog comparator having an input coupled to the ramp signal, and configured to output the delay signal when the ramp signal reaches a reference value. Noteworthy is that this is one way of minimising the amount of circuitry and thus space and thus keeping costs low. See FIG. 5 for example.

Another such additional feature is the analog delay circuit being configured such that any of the ramp of the ramp signal and the value of the reference signal are adjustable according to the common timing offset and the element specific timing offset. Of significance is that these are relatively simple ways to make the timing configurable, and thus use small amounts of circuitry and space and thus keep costs low. See FIGS. 6, 7 and 8 for example.

Another such additional feature is the driver circuit being for use with a common drive signal having common drive pulses with at least twice the frequency desired for the element drive pulses, and the switch controller being configured to control the switch to couple the respective actuating element to a leading edge of a first of the common drive pulses and to a trailing edge of a selected subsequent one of the common drive pulses so as to provide an element drive pulse extending over at least two of the common drive pulses. Of significance is that it can provide more flexibility of timing or width of actuating chamber drive pulses, or can enable coarse pulse width control so that the offsets can then be made using a finer control with less range. See FIG. 11 for example.

Another such additional feature is the switch controller being configured to couple different edges for the respective actuating element from those coupled for an adjacent actuating element so as to provide a phase offset between the element drive pulses of adjacent actuating elements. Notably this can help reduce crosstalk and thus reduce the amount or range of offset needed to compensate for any residual crosstalk, and thus help to simplify the circuitry. See FIG. 12 for example.

Another such additional feature is the common offset circuit having a digital register for storing a value for the common offset and the element specific offset circuit having a digital register for storing a value for the element specific offset. A significance of providing such separate registers is that they can be updated independently and thus communications bandwidth is not wasted on unnecessary updating when one of them (typically the element specific offset) is updated much more frequently than the other. See FIGS. 13 and 14 for example.

Another such additional feature is a sub-drop circuit being coupled to receive a sub-drop timing signal and configured to generate a sequence of offset values corresponding to a sequence of sub-drops within a drop, according to the sub-drop timing signal, and to output the sequence to the timing control circuit for use in the control of timing of the switch control signal. This is a convenient way of implementing sub-drops and sharing some of the same circuitry as is used for other offsets, to reduce a quantity of circuitry and thus reduce costs and reduce thermal dissipation. See FIGS. 13, 14 and 17 for example.

Another aspect of the invention provides a printer having a driver circuit as set out above.

Numerous other variations and modifications can be made without departing from the claims of the present invention. Therefore, it should be clearly understood that the form of the present invention is illustrative only and is not intended to limit the scope of the present invention.

BRIEF DESCRIPTION OF THE DRAWINGS

How the present invention may be put into effect will now be described by way of example with reference to the appended drawings, in which.

DETAILED DESCRIPTION

Figure 1:
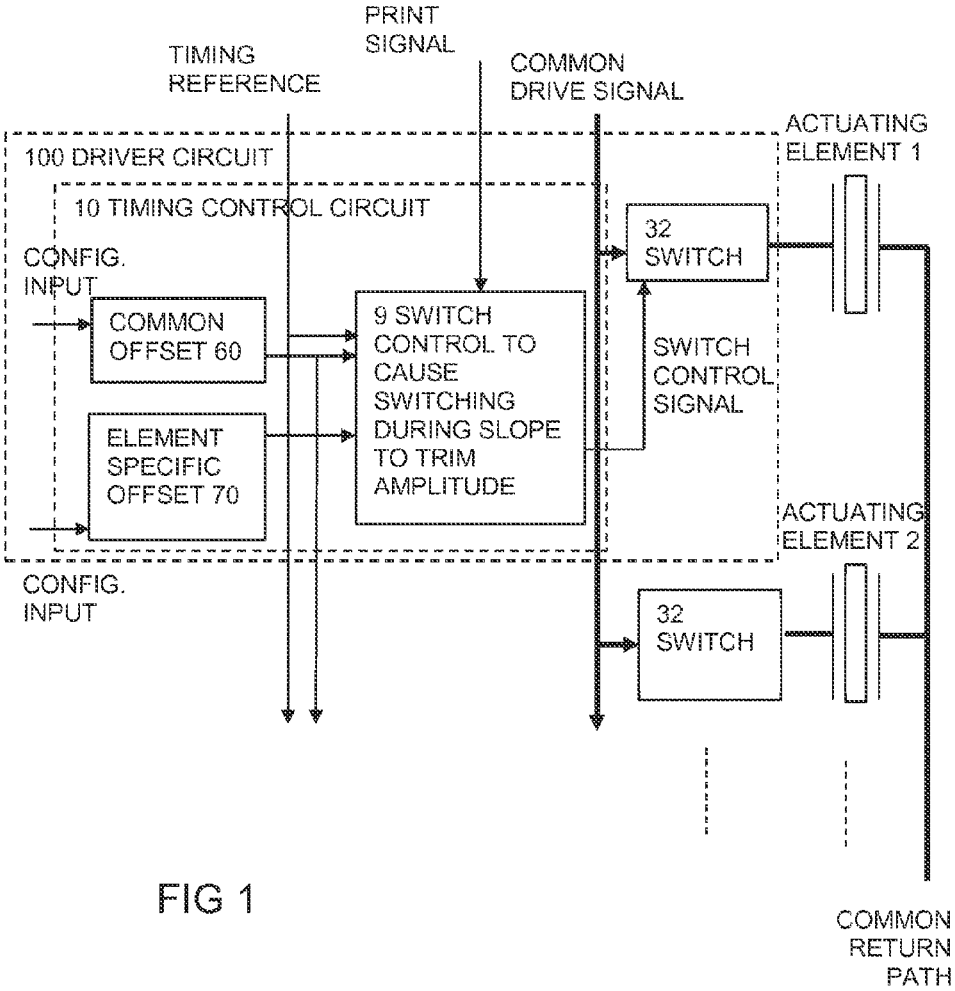
FIG. 1 shows a schematic view of a driver circuit according to an embodiment with common and specific offsets.

The present invention will be described with respect to particular embodiments and with reference to drawings but note that the invention is not limited to features described, but only by the claims. The drawings described are only schematic and are non-limiting. In the drawings, the size of some of the elements may be exaggerated and not drawn to scale for illustrative purposes.

Definitions

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

References to programs or software can encompass any type of programs in any language executable directly or indirectly on any computer.

References to circuits or circuitry or logic or processor or computer, unless otherwise indicated are intended to encompass any kind of processing hardware which can be implemented in any kind of logic or analog circuitry, integrated to any degree, and not limited to general purpose processors, digital signal processors, ASICs, FPGAs (Field Programmable Gate Arrays), discrete components or logic and so on, and are intended to encompass implementations using multiple processors which may be integrated together, or co-located or distributed at different locations for example.

References to actuating chambers are intended to encompass any kind of actuating chamber for ejecting any kind of fluid from a fluid reservoir for printing 2D images or 3D objects for example, onto any kind of media, the actuating chambers having actuating elements for causing the ejection in response to an applied electrical voltage or current. The actuating chamber term is intended to encompass designs in which there is a membrane between a pressure chamber and a nozzle, so that they are not necessarily in fluidic communication or fluidically associated and also designs without such a membrane.

References to actuating chamber typically encompass actuating elements such as a thick or thin film piezoelectric element which is typically associated with a nozzle which is an orifice for droplet ejection and is typically non-active.

References to actuating elements are intended to encompass any kind of actuating element for such actuating chambers, including but not limited to piezoelectric actuating elements typically having a predominantly capacitive circuit characteristic or electro thermal actuating elements typically having a predominantly resistive circuit characteristic.

References to groups or banks of the actuating chambers are intended to encompass linear arrays of neighbouring actuating chambers, or 2-dimensional rectangles or other patterns of neighbouring actuating chambers, or any pattern or arrangement, regular or irregular or random, of neighbouring or non-neighbouring actuating chambers.

Introduction to Features of Embodiments

Variability in actuating chamber performance can cause degradation in image quality during printing. Sources of the variability can be due to manufacturing variability, or due to the operating environment. For example, the frequency at which an actuating chamber is fired affects the drop speed. It is desirable to be able to control individual actuating chambers to allow the printing system to compensate for these effects.

Effects to be compensated for can include for example:

- Firing frequency (same actuating chamber)
- Historic firing effects (same actuating chamber)
- Crosstalk from actuating chambers in close proximity (due to electrical, fluidic and mechanical interference)
- Ambient temperature and ink temperature,
- Aging of PZT (lead zirconate titanate) material/MEMS structures An issue is how to trim the electrical drive for a piezoelectric actuating element for an actuating chamber at the lowest cost, and with the lowest power dissipation while still meeting trimming requirements. If hot switch methods that vary the pulse width of the drive pulse to each actuating element, or vary the voltage level at each pulse, are used, this has a large thermal impact. All of the drive power plus baseline power is dissipated in the head and there tend be larger areas for these designs, meaning added costs in the ASIC.

FIG. 1 Driver Circuit Embodiment with Common and Specific Offsets

FIG. 1 shows a schematic view of a driver circuit 100 according to an embodiment. This and other embodiments are based on driving actuating elements from a common drive waveform using a switch 32, known as a demux switch, that is turned on and off at defined times during the rise and fall times of the common drive waveform. The precision of the switching, if sufficiently accurate, provides a cold switch system that couples only a portion of the rise or fall of the pulse in the common drive signal through to the respective actuating element. This means the pulse height is adjustable, for trimming, and can maintain all of the other arbitrary waveform benefits and thermal advantages of cold switch systems. Other arrangements of cold switching of any type can be used. Notably the trimming can include a component common to many actuating elements and a component specific to each actuating element, and various ways of implementing this, and various additional features will be explained.

In FIG. 1, a timing control circuit 10 provides a switch control signal to control the switch during slopes of the common drive signal. A switch and a timing control circuit are provided for each of the actuating elements. Two such actuating elements 1 and 2 are shown, though there can be many more, not shown for the sake of clarity. The dashed lines on the right of the figure indicate the possibility of repeating components for additional actuating elements. Although shown with the switch located between the common drive signal and the actuating element, other arrangements are feasible, for example with the actuating element in between the common drive signal and the switch. A timing reference signal is fed to the timing control circuitry, this timing reference can be generated locally or provided globally for all driver circuits, and should be synchronised in some way with the pulses of the common drive signal. This can imply the timing reference is generated from the common drive signal or that they both have a common synchronising source for example. The timing control circuit can be implemented in digital or analog circuitry for example, and in various ways. The timing control circuit in this example has a switch control circuit 9 to output a switch control signal so as to cause switching during a slope or edge of a common drive waveform. The timing of the switch control can be set according to a configurable common offset circuit 60, and according to an element specific offset circuit 70. These parts can generate signals or output stored values stored locally as part of the driver circuit, in digital registers, or in other cases may process analog signals, generated off the driver circuit for example. In some alternative examples the functions of the switch control circuit can be incorporated into the element specific offset circuitry.

Configuration inputs are shown to indicate that these signals, values or stored values are configurable. The source and control of the configuration inputs depends on the type of compensation. For example if compensating for thermal changes, then a temperature sensor could provide an input to a look up table or a processor, for converting a temperature reading into an offset configuration input. One of the effects of separating the common offset and the element specific offset is that the circuitry for each can be optimised, for example so as to reduce duplication of circuitry in each of the driver circuits, and to reduce a quantity of element specific data to be processed and sent to each of the driver circuits, or to reduce the precision needed, and thus save quantity or cost of circuitry.

Figure 2:
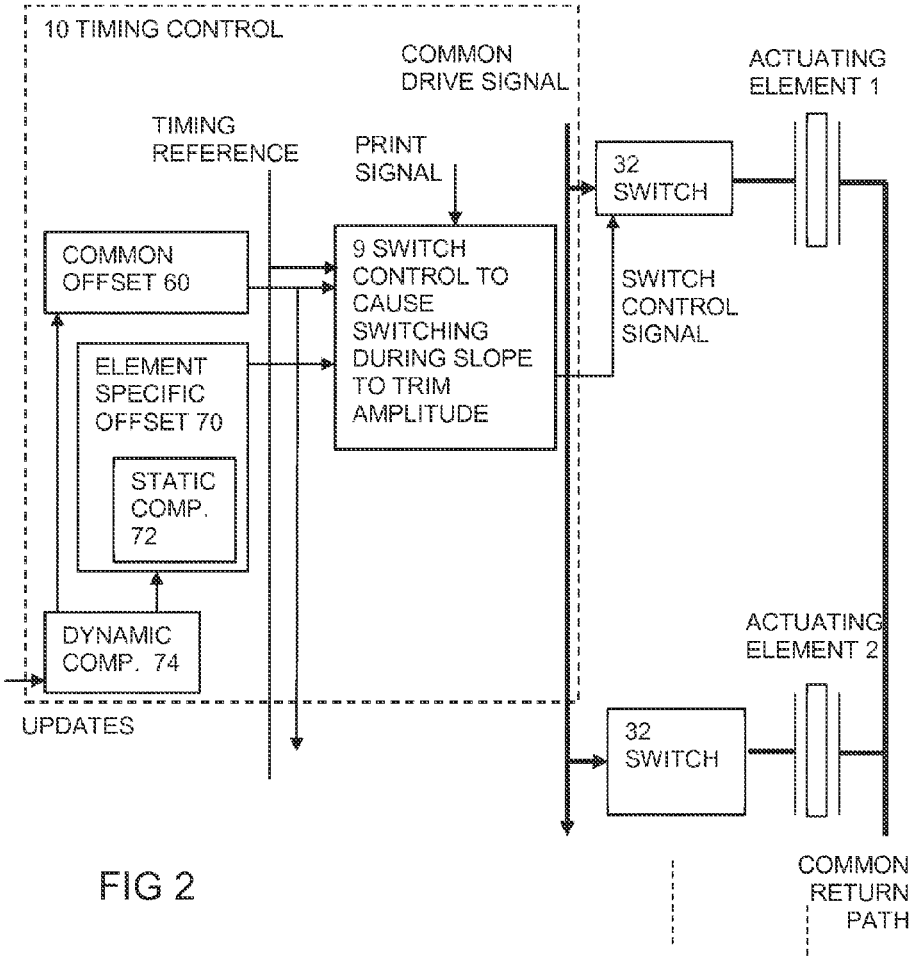
FIG. 2 shows a schematic view of a driver circuit according to an embodiment with static and dynamic offsets.

FIG. 2 Driver Circuit Embodiment with Static and Dynamic Offsets

FIG. 2 shows a schematic view of a driver circuit according to another embodiment similar to that of FIG. 1, and corresponding reference numerals have been used as appropriate. In this case the element specific offset circuit has a static component circuit 72 for providing part of the timing offset. There is also a dynamic component circuit 74 for providing a dynamic part of the timing offset by updating the common offset circuit, or the element specific offset circuit or both of them. Again these parts can be implemented in various ways in principle, as digital registers or buffers for analog signals for example. This separation can help enable a reduction in the quantity of data to be updated rapidly for each driver circuit, or enable a reduction in circuit precision requirements, for example in terms of numbers of bits. Thus circuitry can be simplified, or less data communicated, thus leading to lower costs or lower thermal dissipation for example.

Figure 3:
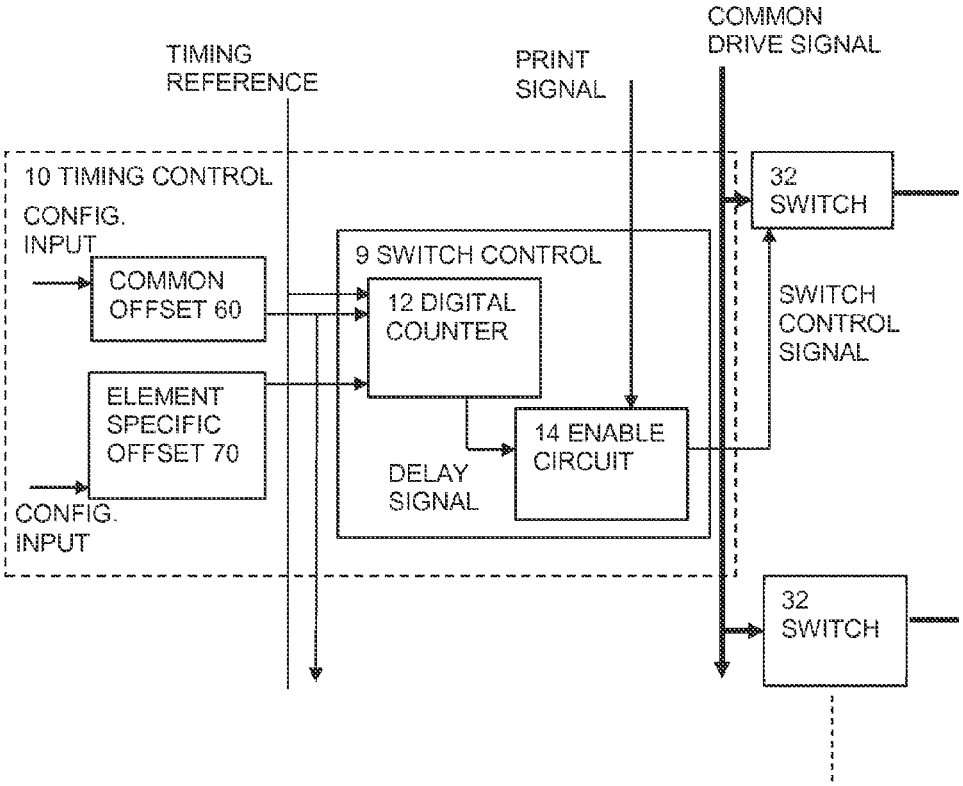
FIG. 3 shows a schematic view of a driver circuit according to an embodiment with digital delay.

FIG. 3 Driver Circuit Embodiment with Digital Delay

FIG. 3 shows a schematic view of a driver circuit according to another embodiment similar to that of FIG. 1, and corresponding reference numerals have been used as appropriate. In this case the timing control circuit has a digital counter 12 configured to provide a delay signal with a configurable time delay relative to a reference time signal. By having separate common and specific timing offsets with a digital counter for timing, fewer counter bits need to be provided for every actuating element, so the circuit can be simpler and cheaper. In this example the print signal is used as a logical input to an enable circuit 14 to control whether the delay signal is used to cause the switch to be controlled to feed part of the common drive signal to that one of the actuating elements. This is one way of using the print signal, but others can be envisaged. For example, it could be used to enable the digital counter.

Figure 4:
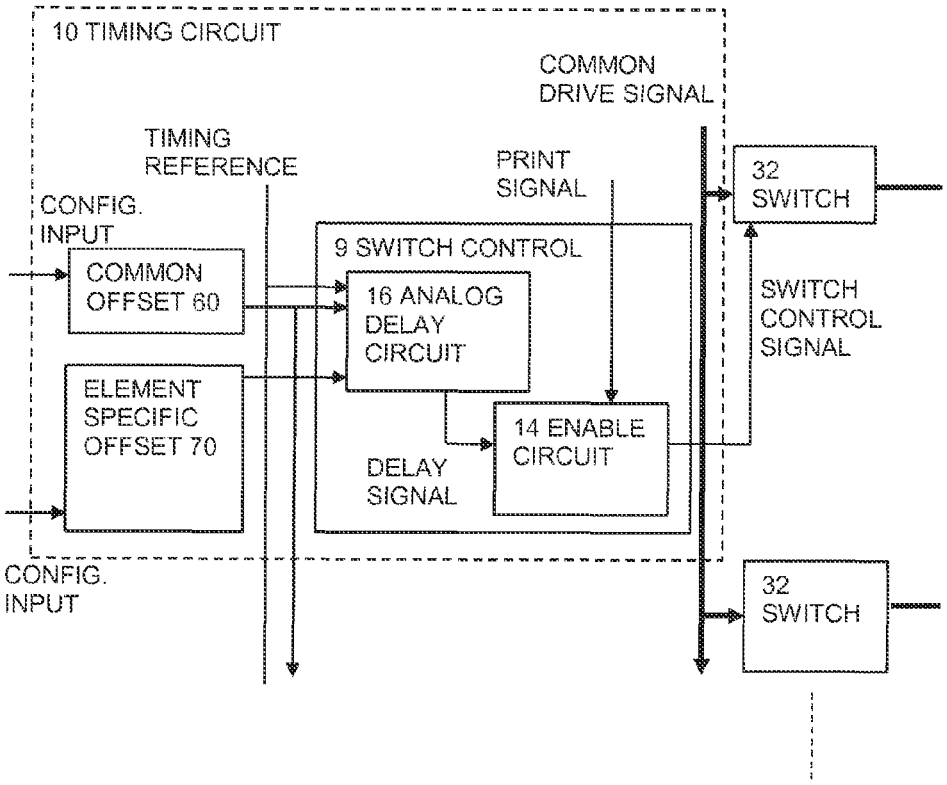
FIG. 4 shows a schematic view of a driver circuit according to an embodiment with analog delay.

FIG. 4 Driver Circuit Embodiment with Analog Delay

FIG. 4 shows a schematic view of a driver circuit according to another embodiment similar to that of FIG. 1, and corresponding reference numerals have been used as appropriate. In this case the timing control circuit has an analog delay circuit 16 configured to provide a delay signal with a configurable time delay relative to a reference time signal. This can be used to control the timing of the switch control signal according to the delay signal. By providing separate common and specific timing offsets with an analog delay circuit, simpler circuitry can be provided for every actuating element, so the circuit can be simpler and cheaper, and more precision can be realised without a corresponding increase in circuit size. Again the print signal is coupled as a logical input to an enable circuit 14 to control whether the delay signal is used to cause the switch to be controlled to feed part of the common drive signal to that one of the actuating elements.

Figure 5:
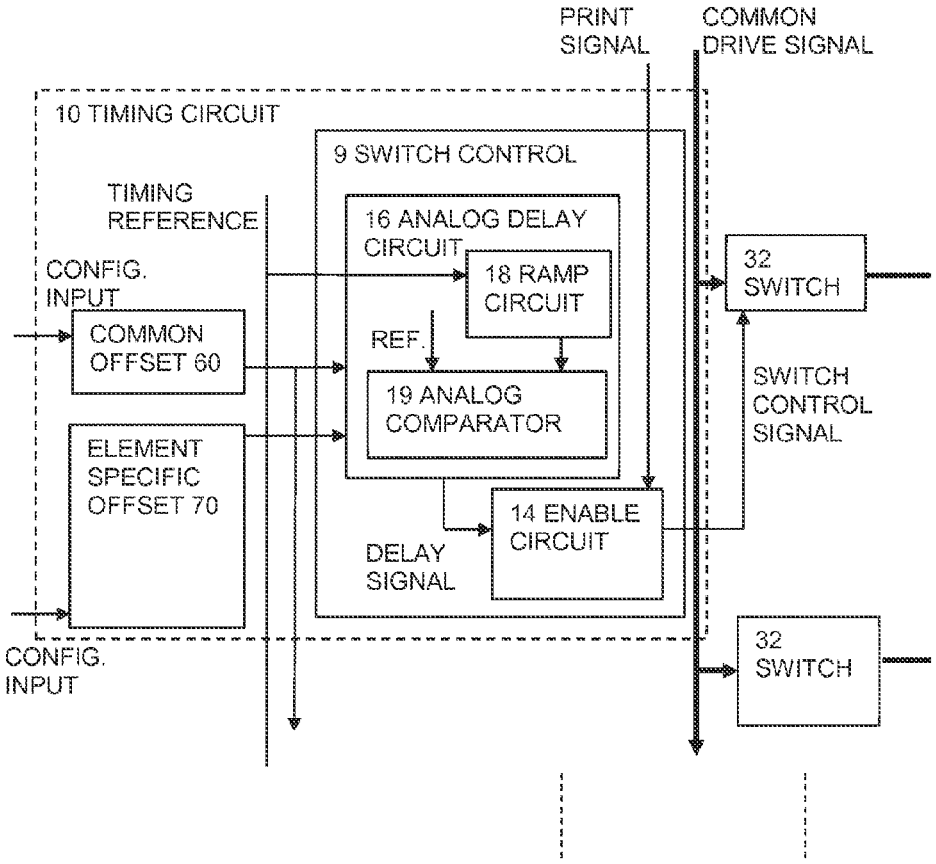
FIG. 5 shows a schematic view of a driver circuit according to an embodiment with analog ramp and comparator.

FIG. 5 Driver Circuit Embodiment with Analog Ramp and Comparator

FIG. 5 shows a schematic view of a driver circuit according to another embodiment similar to that of FIG. 4, and corresponding reference numerals have been used as appropriate. In this case the analog delay circuit 16 has a ramp circuit 18 configured to provide a ramp of a defined gradient, triggered by the timing reference. The delay signal with a configurable time delay relative to the reference time signal is generated by the output of an analog comparator 19. This is coupled to compare the ramp generated by the ramp circuit, with a reference value. The delay can be configured in various ways, for example by using the offset values to control the gradient of the ramp, or to offset the ramp or to alter the reference value input to the comparator in some way. The ramp and comparator is one way of minimising the amount of circuitry and thus space and thus keeping costs low. Making either the ramp or the reference value, or both, adjustable according to the common timing offset and the element specific timing offset are relatively simple ways to make the timing configurable, and thus use small amounts of circuitry and space and thus keep costs low.

Figure 6:
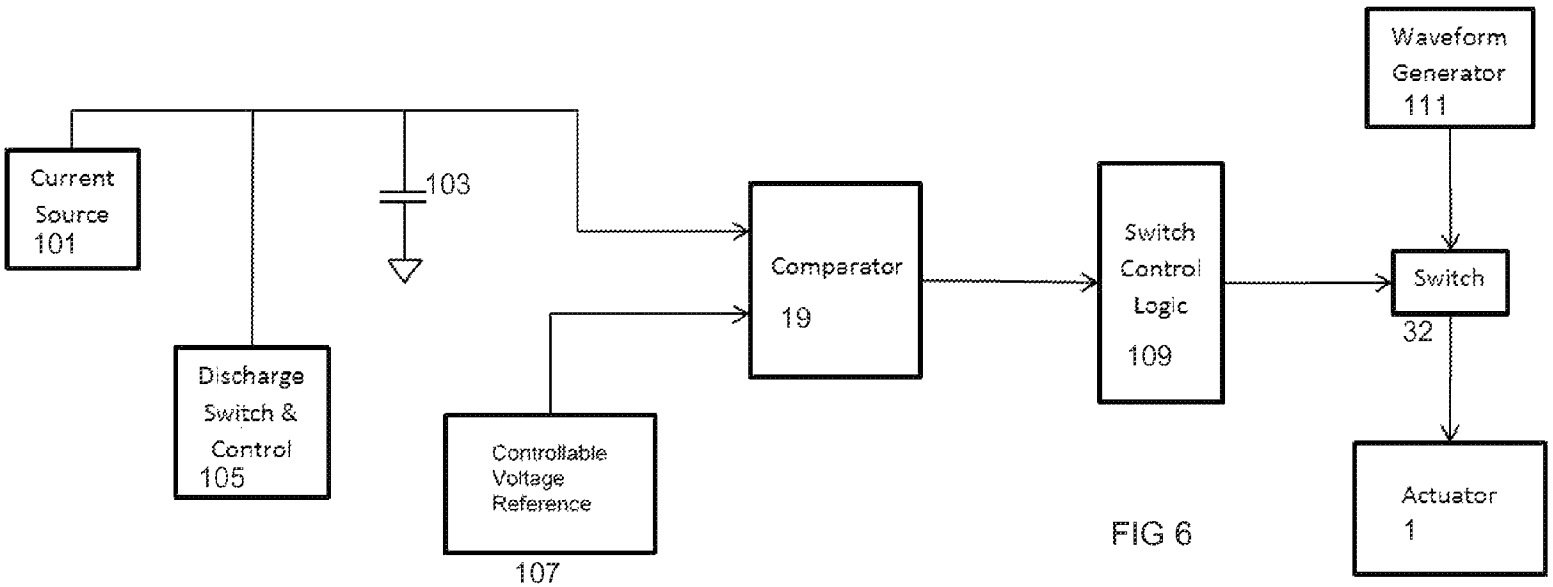
FIG. 6 shows a schematic view of a driver circuit according to an embodiment with analog comparator and controllable voltage reference.

FIG. 6 Driver Circuit Embodiment with Analog Comparator and Controllable Voltage Reference FIG. 6 shows a schematic view of a driver circuit according to another embodiment similar to that of FIG. 5. In this case the ramp is provided by a current source 101 driving a capacitive load 103. A discharge switch and control circuit 105 is provided to discharge the capacitor and trigger the start of the ramp, synchronised with the pulses of the common drive signal. A controllable voltage reference 107 is controlled according to the desired offset values, the common offset and the element specific offset. As in FIG. 5, the delay signal output by the comparator 19 is fed to switch control logic 109, which can provide for example gating with a print signal, and/or with a sub drop timing signal. The output of the switch control logic is used to control the switch 32, to control the coupling of the common drive waveform from a waveform generator 111 to the actuating element 1.

Figure 7:
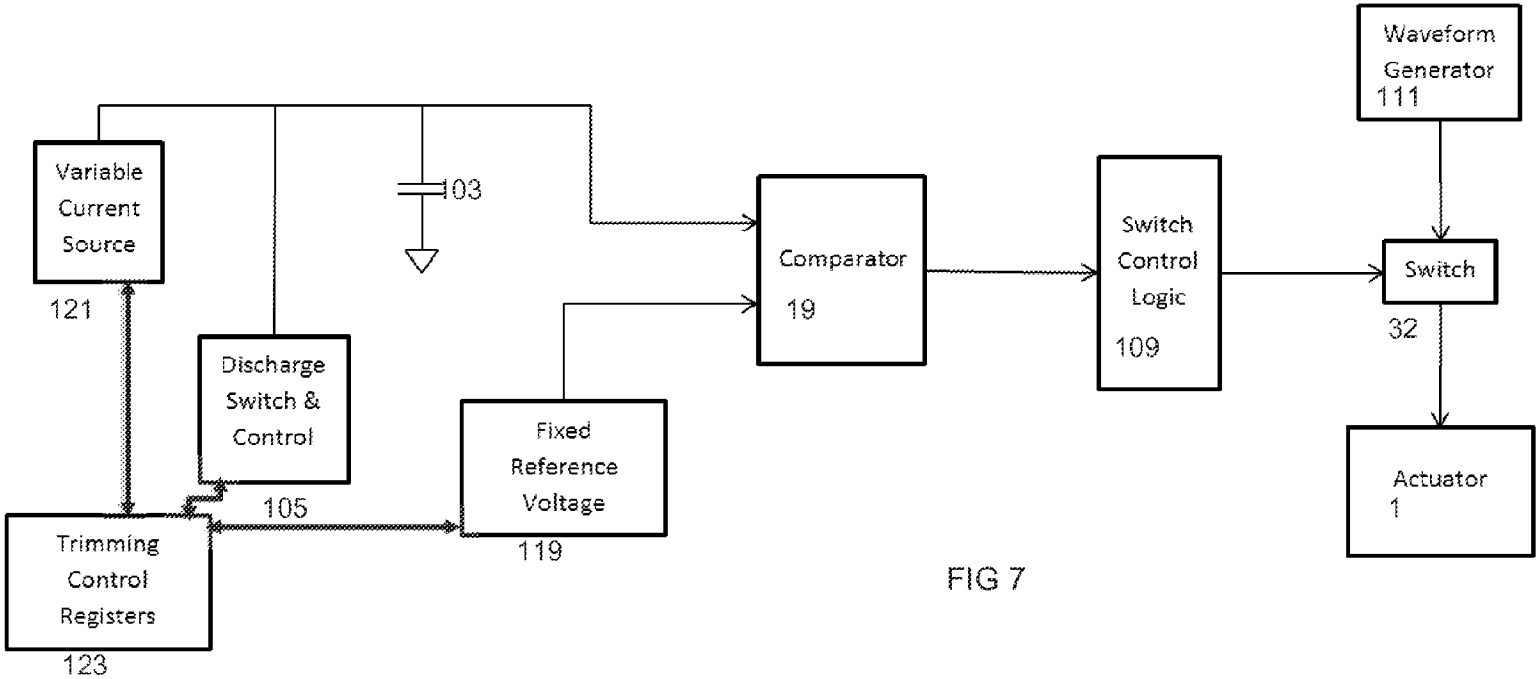
FIG. 7 shows a schematic view of a driver circuit according to an embodiment with analog comparator and controllable ramp.

FIG. 7 Driver Circuit Embodiment with Analog Comparator and Controllable Ramp FIG. 7 shows a schematic view of a driver circuit according to another embodiment similar to that of parts of FIG. 6. In this case there is a fixed reference voltage generator 119, and the ramp is made adjustable using a variable current source 121, adjusted according to trimming control registers 123.

Figure 8:
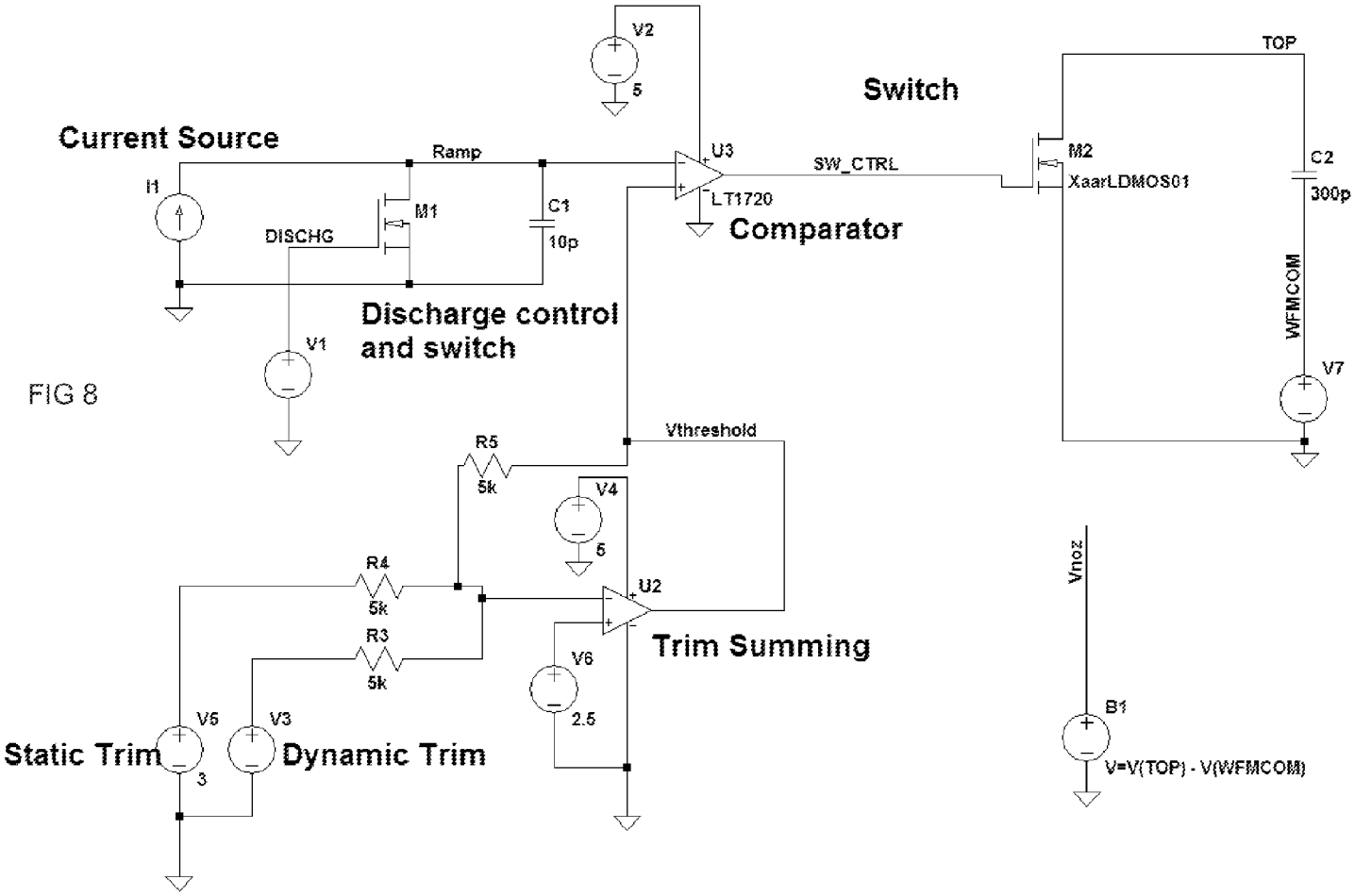
FIG. 8 shows a schematic view of a driver circuit according to an embodiment with analog comparator and summing amplifier.
Figure 9:
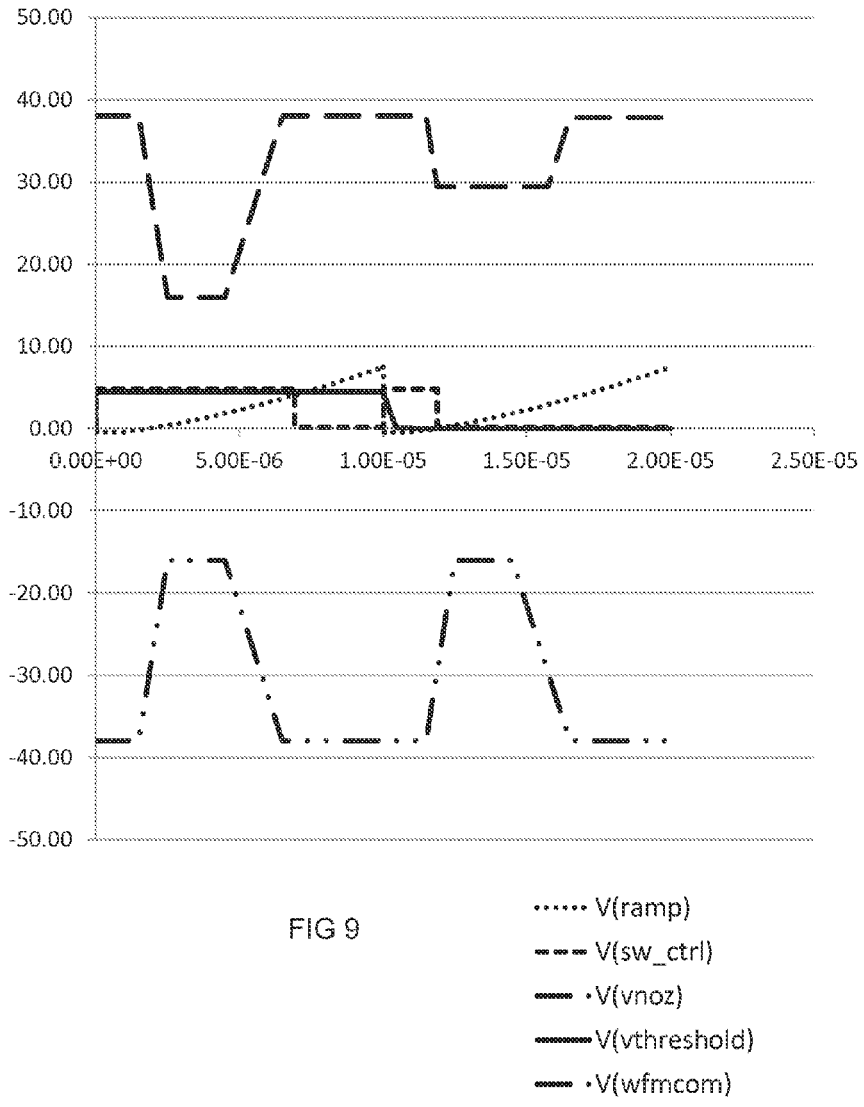
FIG. 9 shows a graph of signals during operation of the embodiment of FIG. 8.
Figure 18:
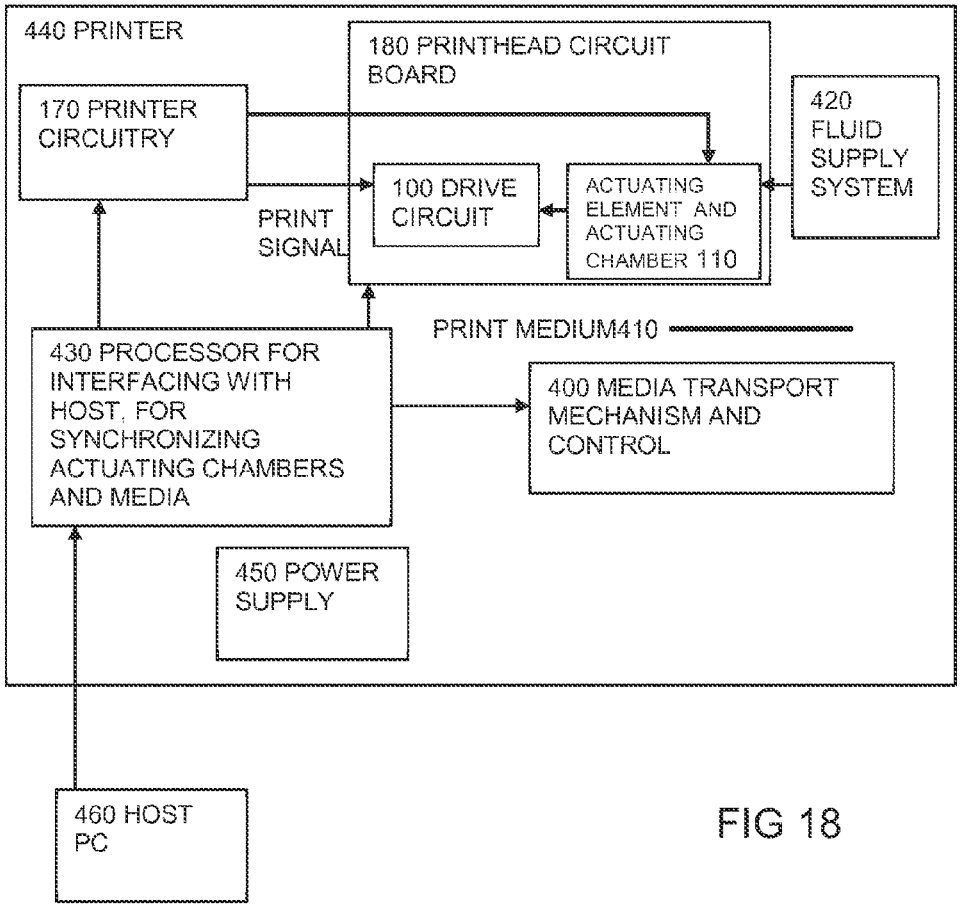
FIG. 18 shows a schematic view of a printer having driver circuitry according to an embodiment.

FIGS. 8, 9 Driver Circuit Embodiment with Analog Comparator and Summing Amplifier FIG. 8 shows a more detailed schematic view of a circuit corresponding to that of FIG. 6. Timing circuitry is shown for generating a switch control signal sw_ctrl, for controlling a switch M2 in the form of an LDMOS device. The drain of M2 is coupled to one side (top) of the actuating element represented by capacitive load C2. The other side of the actuating element is coupled to common waveform generator V7. The timing circuitry includes a current source I1 coupled to a capacitor C1. A discharge transistor M1 is coupled across the capacitor to discharge it, under the control of a discharge signal coupled to the gate of the discharge transistor. The discharge signal is synchronised with the common drive signal. The synchronisation can be carried out in various ways, of which one example is to send a start code in a data packet as part of a data stream from a circuit used to generate the common drive waveform such as the printer circuitry 170 as shown in FIG. 18 described below. The sending of the start code can be clocked with the same common clock as used for triggering the common drive waveform, so as to provide synchronization.

Returning to a description of FIG. 8, the ramp produced by these parts is fed to one input terminal of an analog comparator U3. The other input terminal is coupled to a variable reference voltage generator. This is implemented in this example by a trim summing amplifier U2, which has one input coupled to a fixed voltage v6, and the other input coupled to a summing node for voltages representing trimming offsets. In this case these are dynamic trim and static trim, coupled to the summing node via resistors R3 and R4 respectively. The same circuit could be used for coupling a common offset and an element specific offset. A feedback resistor R5 is coupled from the output back to the summing node.

FIG. 9 shows a graph of signals at various parts of the circuit of FIG. 8 to help explain the operation. Pulses for driving two drops are shown, the first has no trim applied, the second has a change in the dynamic trim value. A bottom line shows the common drive waveform (wfmcom), and an upper line shows the resulting trimmed voltage (noz, where Vnoz=Vtop−Vwfmcom), across the actuating element, showing a full height down going pulse without trimming first, followed by a down going pulse trimmed to about half height. In the middle are shown three traces superimposed.

A first of these traces shown as a dotted line (ramp) shows a voltage ramp generated by the current source driving the capacitive load c1, for input to the comparator, the ramp being retriggered before each of the pulses of the common drive signal. A second trace (vthreshold) shown as a solid line is the threshold voltage—it can be seen that this changes at 10 us based upon the adjustment of the total offset for trimming. This is input to the comparator as shown, and in this case is configured to be high for the first of the pulses and low for the second of the pulses. A third trace shown as a dashed line (sw_ctrl) shows the output of the comparator, used as a switch control signal. This goes low when the ramp meets the level of the total offset, causing the switch to disconnect the common drive waveform from the actuating element during the leading edge of the second pulse, to reduce the amplitude of this pulse compared to the first pulse. The trailing edge of the second pulse of vnoz should follow the common waveform when the common waveform voltage falls sufficiently. In principle this can be implemented by switching on the switch at the appropriate time, though in the example shown, sw_ctrl is not switched on during the trailing edge. Instead, a diode path is provided between drain and source of the transistor of the switch, either using a separate diode or using current flow through the body diode or similar diode path in parallel with the location of a typical body diode of M2 (shown in FIG. 8), the open drain switch, so that the LDMOS M2 does not have to be turned on in a precise manner to complete the pulse. In practice, either this body diode (inherent in LDMOS) would be paralleled with a lower drop Schottky diode for lower power dissipation or M2 could be turned on just past the point of trimming voltage range by a separate timing circuit. These options could improve thermal performance, but the circuit still works using only the body diode. For the second drop the comparator output produces a much shorter switch control signal according to the desired trim adjustment. This shorter pulse turns off the switch part way through the leading edge slope, resulting in a smaller amplitude drive pulse for the second drop.

As discussed above this system assumes cold switch of some type, where a cold switch amplifier, typically on a separate PCB, external to the driver circuitry, drives a switch in open drain configuration, or conventional cold switch type of configuration. The cold switch stays on as the pulse rises part way as it is driven onto the actuating element capacitance. The cold switch is turned off at a specific time related to the common drive waveform, which assumes that the cold switch amplifier provides a controlled and repeatable output waveform. After the cold switch is turned off, the actuating element stays substantially at the set voltage, because there are no paths for current to leak away in the relevant time interval. In one embodiment, when the cold switch amplifier for generating the common drive waveform starts to drive the second edge, the cold switch will be enabled at a voltage as close as possible to the voltage on the actuating element. The inevitable small amount of error here will determine the thermal losses that this technique causes. In another, the body diode or another parallel diode will provide a current path for the trailing edge, and additionally the switch (LDMOS) can be enabled over much of that trailing edge time period to improve thermal performance.

In a typical system there is a single higher level electronics PCB for driving one or more printheads. Each printhead has lower level electronics on it, such as an ASIC as described below with regard to FIG. 13 or 14, including voltage trim functions, typically including some common circuitry, and some circuitry specific to each actuating element. Thus when the first edge of the pulse occurs, the cold switch can stop the charge going in when the desired voltage is reached. The control of the switch is based upon the desired variable time from a pre-determined point. Using analogue components is one way of implementing this configurable time delay, whereby a voltage ramp is created and the voltage of the ramp is then compared to a reference and when exceeded, the switch is turned off.

Two options have been described to adjust the timing (others are possible):

1—the ramp rate can be changed by adjustment of current source

2—the reference voltage can be adjusted

The trim amount (which is controlled by either the ramp rate or the reference voltage for example) is made up of two components. The first is set at startup and adjusted to compensate for static variations. This static trim may be a per-actuating chamber trim or a common trim or both depending upon requirements. The second part of the trim can dynamically vary from drop to drop based upon values such as calculated image data which affects cross talk.

Notably the arrangements described can enable lower cost manufacture, and can work with existing cold switch designs. They can combine features of existing designs with some added analog and digital circuitry (which can be low cost & low power) to enable the trim with little alteration in some cases. Furthermore thermal performance is good, there is little added power, and the low power cold switch arrangement is compatible. By allowing per actuating chamber voltage trimming, problems such as crosstalk can be addressed cost effectively as well as other compensation including adjusting for actuating element variability.

Figure 10:
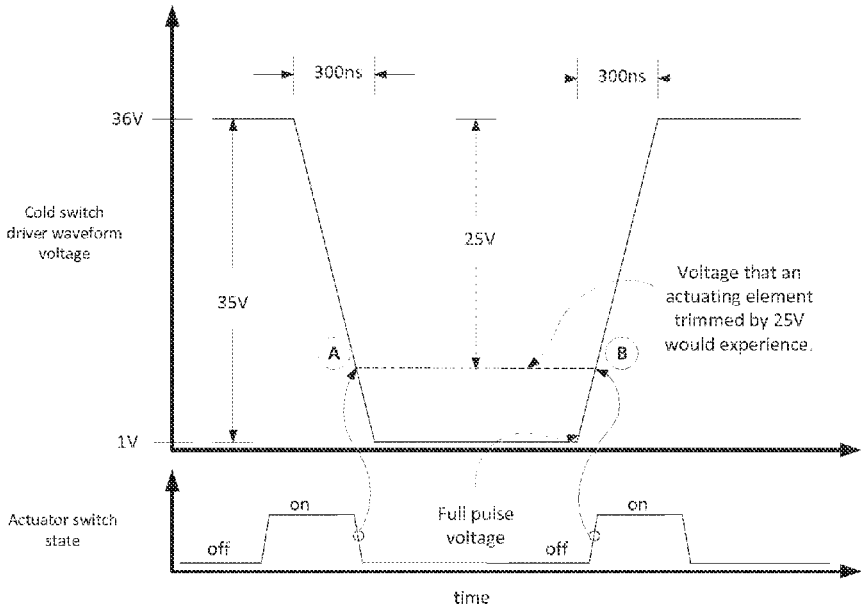
FIG. 10 shows a graph of a pulse showing amplitude trimming.

FIG. 10, Graph of Adjusted Pulse

FIG. 10 shows a single pulse of the common drive waveform showing the effect of controlling the timing of switching. This shows a cold switch driver (also referred to as common drive) waveform and shows a dotted line A-B showing the effect of trimming the voltage level by 25 v rather than the untrimmed 35 v. These voltages can be selected according to the type of actuating element or actuating chamber. In this case the pulse slopes are 300 ns long though other values can be chosen. Below is a corresponding waveform of the switch state which corresponds to the control provided by the further trim signal. When the switch is ON, the voltage across the actuating element will follow the common drive waveform. When the switch state is OFF, the voltage across the actuating element will remain roughly constant. Hence, in the example shown, the actuating element state is on for most of the negative slope, until the waveform has changed by 25 v, at point A. Then the actuating element state is switched off, at a timing controlled according to the trim signal. This means the voltage across the actuating element follows the dotted line, rather than following the solid line. At point B, the switch state changes to the ON state. The voltage across the actuating element follows the positive slope of the common drive waveform.

Figure 11:
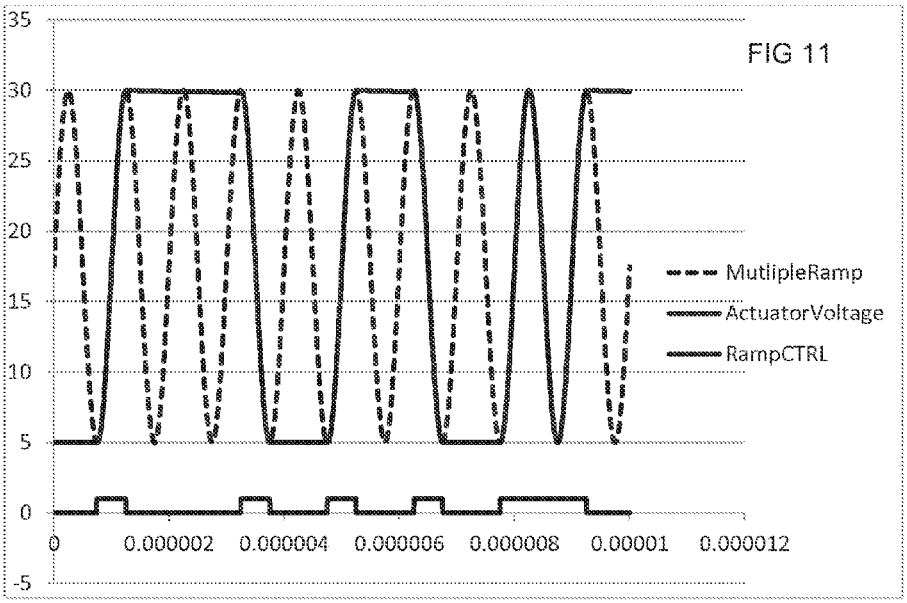
FIG. 11 shows a graph of signals for operation of higher frequency common drive embodiments showing different pulse widths.
Figure 12:
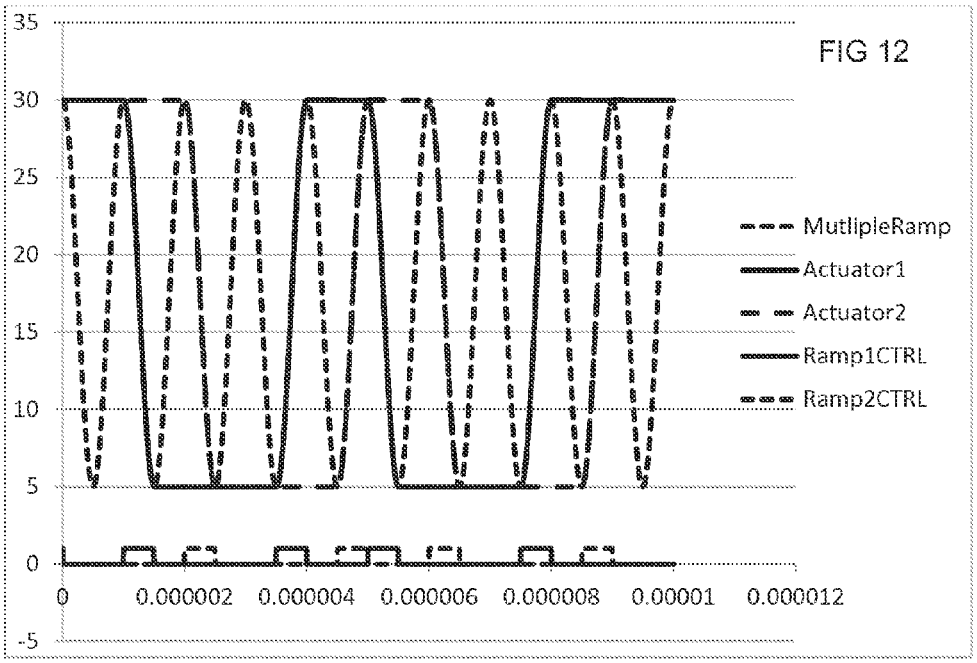
FIG. 12 shows a graph of signals for operation of higher frequency common drive embodiments showing pulse widths.

FIGS. 11, 12, Graphs Showing Higher Frequency Common Drive Waveform

Firing all actuating elements in a printhead simultaneously can cause cross-talk effects (from mechanical, fluidic and electronic interactions for example). This can affect drop speed and volume on ejection. Another issue with such simultaneous actuation is that any shared signals/power planes in the printhead are required to carry the current for all actuating elements at the same time rather than a staggered current (resulting in a lower peak current). Additionally for drop placement control the ability to place a droplet at sub-droplet offsets adds the ability to correct for other factors which can cause problems with image quality.

In order to address these and other issues and achieve a timing offset of waveform outputs from a cold switch arrangement, the common drive waveform is input at a higher frequency, typically at least twice the frequency of the desired drive pulses. The switch selects the required edges for rise and fall and relies on capacitance in the actuating element to hold the voltage whilst the switch is open. A slightly more complicated version would use a single pole triple throw switch in place of the switch above. The central contact would be connected to the high-frequency waveform with the other two contacts being connected to the required high and low voltages. This setup is less prone to cross-talk effects; however, it is more expensive.

By selecting different edges from the same higher frequency input the output produced can be varied without requiring multiple inputs. The selection of edges within a single waveform mean that the additional cost of multiple amplifiers to produce the multiple variations of waveforms is avoided. The switching circuits otherwise required to select the appropriate waveform from the multiple inputs is also not required which can also reduce the cost of the solution.

In the diagrams of FIGS. 11 and 12, there is shown the common drive waveform which is a regular series of pulses or sine waves at a frequency higher than the required output, at least twice the frequency, to enable different edges to be selected. The trace at the bottom of the graph shows the switch control, with high representing the switch being on and so coupling the common drive waveform. The resulting drive pulses across the actuating element are shown superimposed on the common drive waveform. This shows pulses having multiple different pulse widths, by selecting which edges of the common drive signal are coupled to the actuating element. As shown the first pulse has a width of three of the common drive pulses, the second has a width of two of the common drive pulses, and the third has a width of one of the common drive pulses. Since the switch settings control a single actuating chamber, multiple actuating chambers can utilise the same input signal to create different pulse-width outputs. This can be controlled to generate sub drops of different pulse widths, or to provide trimming with a greater range of different values, to complement the finer trimming of the pulse amplitude as explained above for example.

FIG. 12 shows a similar graph to that of FIG. 11. In this case the same common drive signal can also be used to generate waveforms which are off-set relative to each other, for adjacent actuating elements for example. This can be used to help reduce cross talk and peak current surges without needing multiple different common drive waveforms. The graph shows at the bottom two switch control signals superimposed, one for each of the adjacent actuating elements. Two resulting drive pulses are shown, both having pulses that are the width of three of the common drive pulses. These two resulting drive pulses for adjacent actuating elements are out of phase with each other by one common drive pulse width. The resulting drive pulses need not have the same widths, and although shown with the full amplitude, of course the amplitude can be trimmed as described above for FIGS. 1 to 10. This combination can give more control over the shape of the drive pulses. If the edge selection is used for coarse trimming control, it may enable the amplitude trimming to be used only for fine control over a smaller range, thus enabling simpler or cheaper circuitry to be used. Other similar examples can be envisaged.

Figure 13:
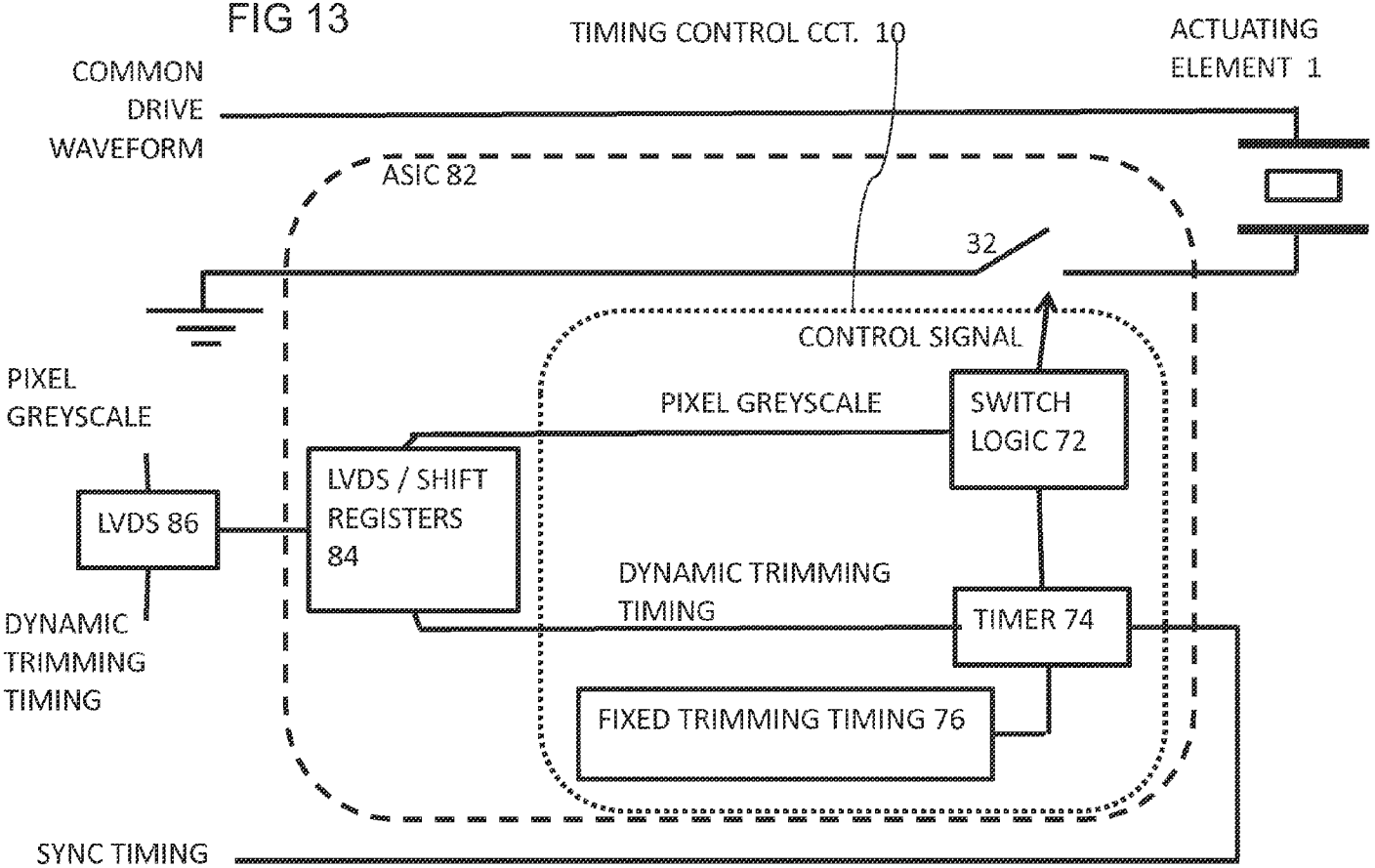
FIG. 13 shows a schematic view of a printhead and driver circuit according to an embodiment with greyscale and dynamic and static trim.

FIG. 13, Printhead According to an Embodiment

FIG. 13 shows a schematic view of a printhead according to an embodiment. A common drive signal is coupled to an actuating element 1, and the common return is coupled via a switch 32. In this case the timing control circuit 10 is shown in the dotted line and has switch logic 72, a timer 74 and optionally a fixed trimming timing part 76 for compensating for manufacturing variations. These logic parts and the switch 20 can be implemented as shown on an ASIC 82. One instance of the LVDS/Shift registers 84 is provided common to all actuating elements, while the other parts of the ASIC, that is the switch 32, switch logic 72, and timing circuitry including a timer 74 and fixed trimming timing 76, are provided one set for each actuating element. Optionally there is a level shifter circuit (not shown here) to enable the switch logic to drive the gate of the switch. The LVDS/shift registers part 84 can be arranged to demultiplex print signals such as pixel greyscale for each actuating element, and can pass on any dynamic timing information for trimming the timer part 74. Outside the ASIC is shown an LVDS interface 86 for coupling logic input signals into the ASIC from for example the FPGA 120 on the printer circuit board. These input signals can include print signals such as pixel values in the form of greyscale values for example, for each actuating element in an array, and optionally any dynamic trimming timing information which may help ensure more consistent and accurate printing. In principle the adjustments can be made in terms of pulse duration, or peak voltage difference of the pulse. If the drive waveform has ramped transitions then a change in timing can result in more or less of the ramp appearing as a voltage difference, and this can appear effectively as a change in peak voltage difference across the actuating element.

Note that the timing of the switching and also the finer timing for trimming should be synchronized with the media motion encoder driven timing; this is typically handled off ASIC and then synchronisation signals are provided to the timer part 74 on the ASIC as shown. The ASIC can baseline its timing from the provided LVDS clock and the start bits for each print/compensation data packet for example.

Figure 14:
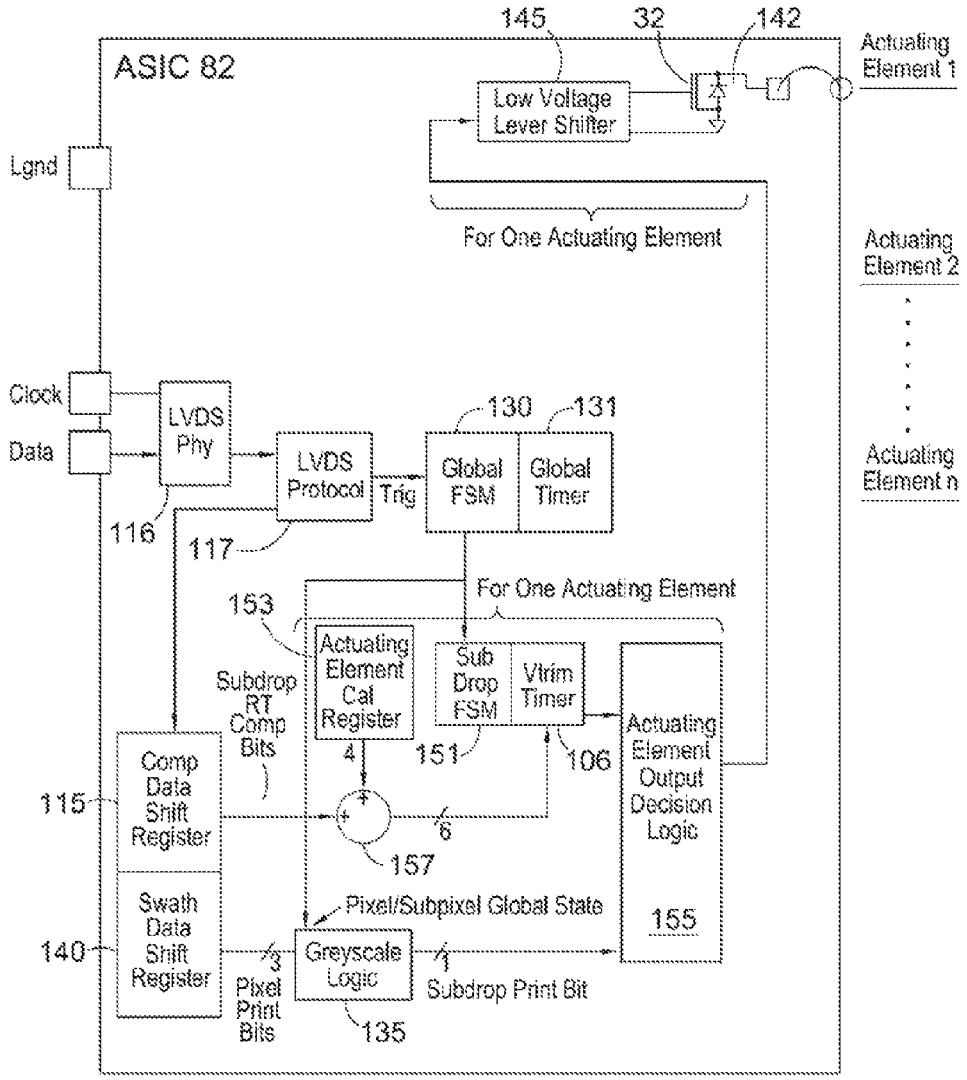
FIG. 14 shows a schematic view of a driver circuit according to an embodiment with registers and sub drop circuitry.

FIG. 14, Driver Circuit Embodiment Showing Registers and Sub-Drop Circuitry

FIG. 14 shows a schematic view of a printhead circuit according to another embodiment. This diagram focuses on the elements in the signal path, shown at a block level, implemented as an ASIC (Application Specific Integrated Circuit) for implementing the lower level electronics present on the printhead module itself. The ASIC is coupled to receive signals from higher level electronics on a Printed Circuit Board (PCB) driving multiple printheads. There is a switch 32 implemented in the form of a high voltage transistor such as an LDMOS device, with a diode 142 either in the form of a body diode, or as an added component coupled to allow conduction from drain to source. A low voltage level shifter 145 is provided to shift a voltage level of a signal for controlling the switch. The switch is coupled in series with an actuating chamber and a drive signal generator (not shown).

The ASIC also includes an actuating element output decision logic part 155, fed by a print signal in the form of a sub-drop print bit and fed by an output of a Vtrim timer part 106. This can be a digital timer as described above, or can use analog parts as described above. It has an output delayed by an offset indicated by a digital signal fed by an adder 157. This can be a digital adder, fed by a digital signal from an external data interface via a compensation data shift register 115, providing a common offset, and by an actuating chamber calibration register 153, providing an element specific offset. If analog parts are used for the timer part 106, then the digital register outputs can be fed to DACs before adding, and the analog signals can be added by a summing amplifier for example. The timer is triggered by a reference signal derived by a sub drop Finite State machine FSM 151, for producing timings of individual sub drops. The external data interface includes in this case an LVDS physical interface 116, and an LVDS protocol part 117.

To save cost in the integrated circuit die, the common offset circuitry can have common (also called global) circuitry to provide part of the timing delay function needed to cause the actuating elements to switch at the right time to produce appropriate trimming functions. This global circuitry may incorporate a finite state machine (FSM) 130 that can incorporate a timer function in its design, or make use of a separate global timer function 131. This global timer function could have an analog component, though this may not be able to equal the very low cost of a digital implementation amortized over the number of actuating chambers. Also a digital implementation, even though it could take more area than certain typical analog implementations, would be fully deterministic and require less engineering resource to design and to place into manufacturing. FIG. 14 illustrates this in general, where there is a global timer and a per actuating chamber timer. The global timer can exist for multiple sections or groups of actuating chambers so that groups of actuating chambers can have their global timing offsets adjusted separately. This allows the needed timing range and perhaps resolution of the per actuating chamber timers to be reduced, saving area and hence cost.

The actuating element output decision logic part 155 also has an input of sub-drop print bits in a sequence generated by a greyscale logic part 135. This generates the sequence and selects which sub-drops are active, based on a 3 bit (for example) greyscale signal from a Swath data shift register 140. Examples of sub-drops are described in more detail below with reference to FIG. 17.

In operation, as described above, when the leading edge of the common drive waveform pulse occurs, the cold switch can stop the charge going into the actuating element capacitance when the desired voltage is reached. The timing of this switching activity can be controlled based on a global timer on the actuating element drive ASIC on the printhead. The timing of this global timer can be communicated by either the start of a packet transmitted from the higher level electronics to the driver circuitry with an offset value communicated with the packet, or with a separate wire or wires to signal the start of a count. Registers on the ASIC indicate at what times the cold switch waveform is to be switched on and off relative to the global timer. A global counter may be used to carry out counting for much of the time period up to the needed timing range for per actuating chamber adjustment. Then a per actuating chamber counter can take over. The value sent to the per actuating chamber counter register can be either a sum of the actuating chamber offset register and the value sent to the actuating chamber in real time per sub-drop time period, or the bits can be combined simply with the LSB being from the per actuating chamber register. The former allows for more flexibility and the latter can reduce gate counts.

After the cold switch is turned off, the actuating element remains at the substantially the same voltage, because there are no paths for charge to leak swiftly out of the actuating element. When the cold switch amplifier for generating the common drive waveform starts to drive the second edge, the cold switch will be enabled at a voltage as close to the voltage set by the first edge as possible. The inevitable amount of error here will determine the thermal losses that this technique causes.

Note that the pulse width will vary slightly with drive voltage amplitude adjustment. If width is defined as the time duration over 50% amplitude, then as the voltage is decreased, the pulse width will increase. The increase is dependent on the slope of the pulses, the faster the slopes and smaller the pulse width change as the amplitude is altered. This can have an impact on MEMS performance and may need to be taken into account.

The switch in FIG. 14 is in open drain configuration, but could also be an industry cold switch type of configuration, with a pass gate, and a high voltage level shifter to drive the switch. Notably these arrangements described can enable lower cost manufacture. Again they can combine features of existing designs with some added circuitry (which can be low cost & low power) to enable better trim with little additional circuitry in some cases. Furthermore thermal performance is good, as there is little added power dissipation, and they are compatible with existing low power cold switch arrangements. By allowing per actuating chamber voltage trimming, problems such as crosstalk can be addressed cost effectively as well as other compensation including adjusting for actuating element variability.

Figure 15:
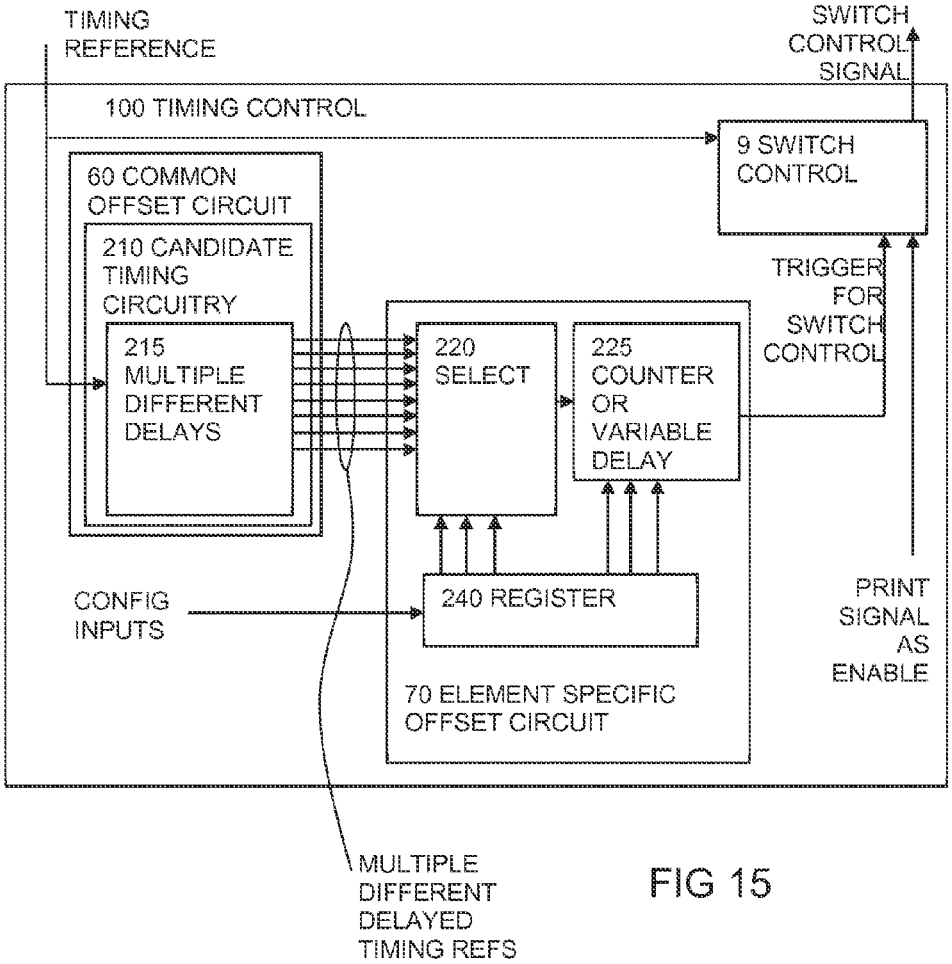
FIG. 15 shows a schematic view of an embodiment with multiple common timing signals and a selector.

FIG. 15 Embodiment with Multiple Common Timing Signals and Selector

It is also possible to combine global and per actuating chamber digital and analog timing in several ways to produce trade-offs between the reliance on analog accuracy, digital area and use of interconnect wiring. For example, as shown in FIG. 15, the common offset circuit 60 can have candidate timing circuitry 210 in the form of multiple different delay circuits 215 to provide many differently delayed versions of a timing reference, all sent in common to the element specific offset circuits, or at least to a group of them. In this example there are eight differently delayed versions (any other number can be envisaged), from which one is selected at the element specific offset circuit for each actuating element to help compensate for differences between the actuating element outputs. Hence three most significant bits of per actuating chamber timing adjustment can be used to select which candidate version is to be used. This selection can be implemented through a selector 220 in the form of a multiplexer in the element specific offset circuit that selects one of the eight global candidate timing signal wires that are coupled to the element specific offset circuits. The delay of the signal coming from each of these eight signals can be equally delayed from each other, so that selecting one of eight of these signals selects one of eight delays equally spaced in time. The selected delayed timing reference can be coupled to circuitry such as a counter or variable delay 225 to implement finer timing offset for trimming. The selection by the selector 220 can be governed by an offset value stored in a register 240. The MSBs (most significant bits) of the value can be used for the selection and the LSBs (least significant bits) for the finer trim adjustment by the counter or variable delay 225. The output of the counter or variable delay can be fed as a trigger signal for the switch control 9. This part can generate the switch control signal enabled by the print signal, and can provide a signal to switch on the switch at the time of the timing reference and switch it off during the leading edge of the common drive waveform at the desired carefully timed point set by the trigger signal. In this way, the digital logic in the actuating chamber needed for the MSBs of a counter style actuating chamber timing function could be minimized, particularly the actuating chamber specific circuitry. The use of multiple different delays assumes that in the process of choice used to build the semiconductor, the interconnect cost of those eight wires is acceptable.

Figure 16:
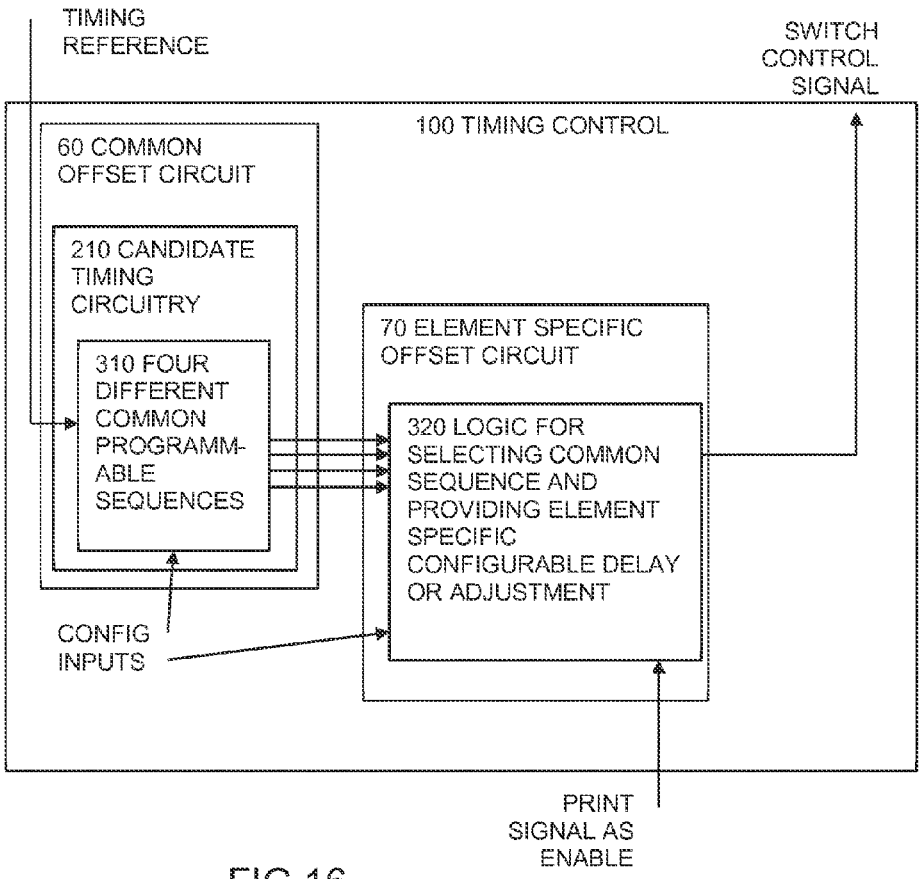
FIG. 16 shows a schematic view of an embodiment with multiple programmable sequences and a selector.

FIG. 16, Embodiment with Multiple Timing Sequences and Selector

Another useful trade off, to reduce the quantity of circuitry needed, involves having a set of global digital functions that provide a set of, for example, four distinct and programmable timings, intended to be used as a basis for actuating chamber timing. FIG. 16 shows an embodiment similar to that of FIG. 15, and shows another example of a common offset circuit having candidate timing circuitry arranged to provide a plurality of different candidate timing offsets to each of the element specific offset circuits. But instead of generating multiple different common candidate timing references, FIG. 16 shows the candidate timing offsets being in the form of multiple different common programmable sequences. This means the common candidate signals are more complete and closer to the desired output switch control signal, than is the case for the example of FIG. 15. This can help reduce the amount of element specific logic needed in the timing control circuitry. For the example of providing four such sequences, then two bits in the actuating chamber could be used to select which of these four globally provided programmable timing sequences are used. This selection can be made by logic 320 for selecting which of the common sequences to use and for providing further finer trimming.

Depending on the shape of the curve of actuating chamber performance across a wafer of the printhead, the user could set these bits to apply different base delays to sets of actuating chambers to allow minimization of the needed time and resolution of timing function residing in the actuating chamber, regardless of whether it is analog, digital or both. The timing sequences could for example be programmed to include a pulse to switch on the switch during part of the leading edge of the common drive waveform and a pulse timed to switch on the switch during part of the trailing edge of the drive waveform as shown in FIG. 10 described above. An alternative sequence could have for example a pulse to switch on the switch during part of the leading edge of the common drive waveform without any pulse during the trailing edge. This could rely on the switch having a body diode and the voltages used enable the body diode to conduct to enable the voltage across the actuating chamber actuating element to follow the trailing edge of the common drive waveform, as described above. In FIG. 16 there is no need for generating the switch control signal by the switch control part 9, as the candidate timing circuitry 210 provides sequences rather than timing references. Hence the print signal is fed directly to enable the output of the logic 320. Although not shown for the sake of clarity, there can be a register 240 as in FIG. 15 for providing MSBs and LSBs of the offset values, which can be a combination of static and dynamic offsets as described above.

Figure 17:
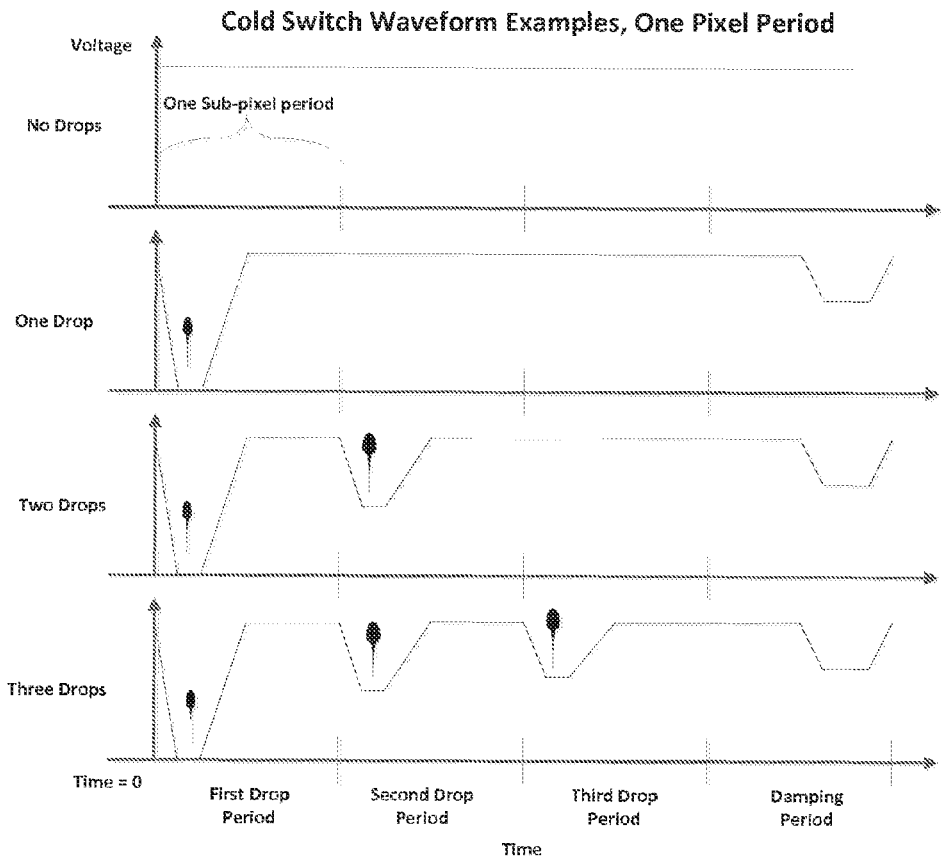
FIG. 17 shows a graph of waveforms for Greyscale, Per Pixel and Per Sub-Drop.

FIG. 17 Waveforms for Greyscale, Per Pixel and Per Sub-Drop

The ASIC controls the switch to provide the externally provided drive signal waveform as a voltage differential across each actuating element during pre-programmed time intervals based on the print signal. The waveform will agitate the ink in the actuating chamber, causing certain amount of ink to be deposited in certain pixel locations on the media, building up the image. The print data may demand more than one drop to be ejected from the actuating chamber for arrival at one pixel location. Each of these ink drops is called a "sub-drop".

The two most significant time intervals for this function are the sub-drop period and the pixel period. The pixel period is the time taken for a media pixel to progress past the selected actuating chamber. The sub-drop period is the time allocated for firing each individual sub-drop.

The ASIC will be able to handle from one to seven sub-drops per pixel period, plus an optional damping period. The damping period fires an off phase pulse only if jetting pulses are fired, to reduce the residual energy in the MEMS for the next pixel.

FIG. 17 shows example actuating element waveforms for a system with up to three sub-drops per pixel fired plus the damping pulse. Slew rate, pulse width and maximum pulse height are set externally to the ASIC, by the externally generated common drive waveform. In FIG. 17, the top waveform, marked "no drops" shows the case of no firing.

This has a greyscale value of "0." The second from top waveform, marked "one drop" shows the case of one sub-drop firing, showing an ejection level pulse in the first sub-drop period and a damping pulse in the damping period. This has a greyscale value of "1." The third from top waveform, marked "two drops" shows the case of two sub-drops firing, showing an ejection level pulse in the first sub-drop and second sub-drop period and a damping pulse in the damping period. This has a grayscale value of "2." The bottom waveform, marked "three drops" shows the case of three sub-drops firing, showing an ejection level pulse in the first drop, second and third sub-drop periods and a damping pulse in the damping period. This has a grayscale value of "3." The sub-drops can be arranged to land on the same place and rely on the total quantity of ink to show the different greyscale or in principle the media can be moved to offset slightly the sub-drops to cause more or less spread in the shape of the ink-spot according to which sub-drops are fired. If the common drive waveform has sub-drops with different peak voltages, as shown, then the amounts of ink in each sub-drop will be different, and so up to 8 different grayscales for a pixel can be achieved from different combinations of the three sub-drops.

In some embodiments, the print head ASIC can handle the logic to implement greyscales by generating pulses to create the sub-drops, but in other embodiments this logic may be implemented by external off printhead logic and the ASIC merely receives data for a series of sub-drops being demanded; the ASIC would not then need to determine which sub-drops make up which drop. In particular embodiments each nozzle can support up to 3 bits/8 levels of greyscale, from 0 (no drop fired) to 7 drops fired. In particular embodiments it will be possible to run with 1, 2 and 3 bits of greyscale, depending on greyscale mode. Different modes of operation will require different numbers of bits of greyscale from 1 bit (either a drop or no drop) to a full 3 bits and 7 greyscale levels (any combination of 3 sub-drops).

FIG. 18 Embodiment Showing Printer Features

The printhead arrangements described above can be used in various types of printer. Two notable types of printer are:

a) a page-wide printer (where printheads cover the entire width of the print medium, with the print medium (tiles, paper, fabric, or other example) rolling under the printheads), and b) a scanning printer (where a bundle of printheads slide back and forth on a printbar, whilst the print medium rolls forward in increments under the printheads, and is stationary whilst the printhead scans across). There can be large numbers of printheads moving back and forth in this type of arrangement, for example 16 or 32, or other numbers.

In both scenarios, the printheads can optionally be operating several different colours, plus perhaps primers and fixatives or other special treatments. Other types of printer can include 3D printers for printing fluids such as plastics or other materials in successive layers to create solid objects.

FIG. 18 shows a schematic view of a printer 440 coupled to a source of data for printing, such as a host PC 460 (which can be external or internal to the printer). There is a printhead circuit board 180 having one or more actuating elements and actuating chambers 110 and a drive circuit 100. Printer circuitry 170, is coupled to the printhead circuit board, and coupled to a processor 430 for interfacing with the host, and for synchronizing drive of actuating elements and location of the print media. This processor is coupled to receive data from the host, and is coupled to the printhead circuit board to provide synchronizing signals at least. The printer also has a fluid supply system 420 coupled to the actuating chambers, and a media transport mechanism and control part 400, for locating the print medium 410 relative to the actuating chambers. This can include any mechanism for moving the actuating chambers, such as a movable printbar. Again this part can be coupled to the processor to pass synchronizing signals and for example position sensing information. A power supply is also shown, for supplying power to the various parts of the printer (supply connections are omitted from the figure for the sake of clarity).

The printer can have a number (for example seven) of inkjet printheads attached to a rigid frame, commonly known as a print bar. The media transport mechanism can move the print medium beneath or adjacent the print bar. A variety of print media may be suitable for use with the apparatus, such as paper sheets, boxes and other packaging, or ceramic tiles. Further, the print media need not be provided as discrete articles, but may be provided as a continuous web that may be divided into separate articles following the printing process.

The printheads may each provide a linear array of fluid chambers having respective actuating chambers for ink droplet ejection, with the actuating chambers in each linear array evenly spaced. The printheads can be positioned such that the actuating chamber arrays are parallel to the width of the substrate and also such that the actuating chamber arrays overlap in the direction of the width of the substrate. Further, the actuating chamber arrays may overlap such that the printheads together provide an array of actuating chambers that are evenly spaced in the width direction (though groups within this array, corresponding to the individual printheads, can be offset perpendicular to the width direction). This may allow the entire width of the substrate to be addressed by the printheads in a single printing pass.

The printer can have circuitry for processing and supplying image data to the printheads. The input from a host PC for example may be a complete image made up of an array of pixels, with each pixel having a tone value selected from a number of tone levels, for example from 0 to 255. In the case of a colour image there may be a number of tone values associated with each pixel: one for each colour. In the case of CMYK printing there will therefore be four values associated with each pixel, with tone levels 0 to 255 being available for each of the colours.

Typically, the printheads will not be able to reproduce the same number of tone values for each printed pixel as for the image data pixels. For example, even fairly advanced greyscale printers (which term refers to printers able to print dots of variable size, rather than implying an inability to print colour images) will only be capable of producing 8 tone levels per printed pixel. The printer may therefore convert the image data for the original image to a format suitable for printing, for example using a half-toning or screening algorithm. As part of the same or a separate process, it may also divide the image data into individual portions corresponding to the portions to be printed by the respective printheads. These packets of print data may then be sent to the printheads.

The fluid supply system can provide ink to each of the printheads, for example by means of conduits attached to the rear of each printhead. In some cases, two conduits may be attached to each printhead so that in use a flow of ink through the printhead may be set up, with one conduit supplying ink to the printhead and the other conduit drawing ink away from the printhead.

In addition to being operable to advance the print articles beneath the print bar, the media transport mechanism may include a product detection sensor (not shown), which ascertains whether the medium is present and, if so, may determine its location. The sensor may utilise any suitable detection technology, such as magnetic, infra-red, or optical detection in order to ascertain the presence and location of the substrate.

The print-medium transport mechanism may further include an encoder (also not shown), such as a rotary or shaft encoder, which senses the movement of the print-medium transport mechanism, and thus the substrate itself. The encoder may operate by producing a pulse signal indicating the movement of the substrate by each millimeter. The Product Detect and Encoder signals generated by these sensors may therefore indicate to the printheads the start of the substrate and the relative motion between the printheads and the substrate.

The processor can be used for overall control of the printer systems. This may therefore co-ordinate the actions of each subsystem within the printer so as to ensure its proper functioning. It may, for example signal the ink supply system to enter a start-up mode in order to prepare for the initiation of a printing operation and once it has received a signal from the ink supply system that the start-up process has been completed it may signal the other systems within the printer, such as the data transfer system and the substrate transport system, to carry out tasks so as to begin the printing operation.

Other embodiments and variations can be envisaged within the scope of the claims.

The invention claimed is:

1. A driver circuit for driving actuating elements for printing, the driver circuit comprising: a switch for a respective one of the actuating elements to selectively couple a common drive signal having a rise and a fall to provide element drive pulses to drive the respective actuating element according to a print signal, and a timing control circuit having:

a common offset circuit to provide a common timing offset relative to a timing reference based on the rise or the fall of the common drive signal for at least two of the actuating elements in common, and an element specific offset circuit to provide an element specific timing offset relative to the timing reference based on the rise or the fall of the common drive signal for a respective one of the actuating elements, wherein the timing control circuit controls the switch during the rise and the fall of the common drive signal such that at least a portion of the rise and the fall of the common drive signal is coupled to the actuating element to create a trimmed signal having a peak amplitude that is less than a peak amplitude of the element drive pulses, the element drive pulses being untrimmed relative to the trimmed signal, and wherein operation of the switch is controlled according to the common timing offset and according to the respective element specific timing offset.

2. The driver circuit of claim 1, the element specific offset circuits comprising a static component circuit for providing a static component of the timing offset, and the driver circuit having a dynamic component circuit for dynamically updating the timing offsets.

3. The driver circuit of claim 1, the common offset circuit having candidate timing circuitry arranged to provide a plurality of different candidate timing offsets to each of the element specific offset circuits, and the element specific offset circuits each comprising a selector for selecting which of the candidate timing offsets to use.

4. The driver circuit of claim 1, the common offset circuit providing a more significant part of the trim and the element specific offset circuit providing less significant part of the trim.

5. The driver circuit of claim 1, the switch comprising a transistor having a body or other similarly configured diode and being coupled in an open drain configuration such that after the switch has been switched off during a leading edge of the common drive waveform, the body diode or equivalent functionality diode can conduct during a trailing edge of the common drive waveform to enable the element drive pulse to follow the trailing edge of the common drive waveform.

6. The driver circuit of claim 1, the timing control circuit further comprising a digital counter configured to provide a delay signal with a configurable time delay relative to the timing reference wherein the delay signal further controls the timing of the switch control signal as a trigger signal to turn on the switch at the time delay.

7. The driver circuit of claim 1, the timing control circuit having an analog delay circuit configured to provide a delay signal with a configurable time delay relative to a reference time signal, and configured to control the timing of the switch control signal according to the delay signal.

8. The driver circuit of claim 7, the analog delay circuit comprising a ramp circuit configured to provide a ramp signal triggered by the reference time signal and an analog comparator having an input coupled to the ramp signal, and configured to output the delay signal when the ramp signal reaches a reference value.

9. The driver circuit of claim 8, the analog delay circuit being configured such that any of the ramp of the ramp signal and the value of the reference signal are adjustable according to the common timing offset and the element specific timing offset.

10. The driver circuit of claim 1, for use with a common drive signal having common drive pulses with at least twice the frequency desired for the element drive pulses, and the switch controller being configured to control the switch to couple the respective actuating element to a leading edge of a first of the common drive pulses and to a trailing edge of a selected subsequent one of the common drive pulses so as to provide an element drive pulse extending over at least two of the common drive pulses.

11. The driver circuit of claim 10, the switch controller being configured to couple different edges for the respective actuating element from those coupled for an adjacent actuating element so as to provide a phase offset between the element drive pulses of adjacent actuating elements.

12. The driver circuit of claim 1, the common offset circuit having a digital register for storing a value for the common offset, and the element specific offset circuit having a digital register for storing a value for the element specific offset.

13. The driver circuit of claim 1, having a sub-drop circuit being coupled to receive a sub-drop timing signal and configured to generate a sequence of offset values corresponding to a sequence of sub-drops within a drop, according to the sub-drop timing signal, and to output the sequence to the timing control circuit for use in the control of timing of the switch control signal.

14. A printer having a driver circuit according to claim 1.

* * * * *